US008303083B2

(12) United States Patent
Fujii et al.

(10) Patent No.: US 8,303,083 B2
(45) Date of Patent: Nov. 6, 2012

(54) LIQUID EJECTION HEAD, IMAGE FORMING APPARATUS EMPLOYING THE LIQUID EJECTION HEAD, AND METHOD OF MANUFACTURING THE LIQUID EJECTION HEAD

(75) Inventors: Kaori Fujii, Atsugi (JP); Kenichiroh Hashimoto, Yokohama (JP); Kohzoh Urasaki, Kobe (JP); Yuta Hiratsuka, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 414 days.

(21) Appl. No.: 12/548,730

(22) Filed: Aug. 27, 2009

(65) Prior Publication Data

US 2010/0053269 A1 Mar. 4, 2010

(30) Foreign Application Priority Data

Aug. 27, 2008 (JP) ..... 2008-217494
Mar. 31, 2009 (JP) ..... 2009-085614

(51) Int. Cl.
*B41J 2/14* (2006.01)

(52) U.S. Cl. ..... 347/47; 347/44; 347/22

(58) Field of Classification Search ..... 347/47, 347/44, 33, 22, 34
See application file for complete search history.

(56) References Cited

U.S. PATENT DOCUMENTS 5,502,470 A * 3/1996 Miyashita et al. ..... 347/45
6,341,836 B1 * 1/2002 Koike et al. ..... 347/20
6,367,914 B1 4/2002 Ohtaka et al.
6,511,156 B1 * 1/2003 Kazama et al. ..... 347/47
6,682,185 B2 1/2004 Hashimoto et al.
6,913,348 B2 7/2005 Hashimoto et al.
7,090,325 B2 8/2006 Hashimoto et al.
7,329,363 B2 * 2/2008 Lim et al. ..... 216/27
7,364,253 B2 4/2008 Hashimoto et al.
7,370,940 B2 5/2008 Hashimoto
7,416,281 B2 8/2008 Nishimura et al.
7,562,964 B2 * 7/2009 Furukawa et al. ..... 347/45
7,837,300 B2 * 11/2010 Mori ..... 347/45
8,047,630 B2 * 11/2011 Kakuda ..... 347/45
2005/0231561 A1 10/2005 Hashimoto
2006/0238579 A1 10/2006 Hashimoto et al.

(Continued)

FOREIGN PATENT DOCUMENTS

JP 10-151744 6/1998

(Continued)

OTHER PUBLICATIONS

U.S. Appl. No. 12/508,719, of Kenichiroh Hashimoto, filed Jul. 24, 2009.

*Primary Examiner* — Matthew Luu
*Assistant Examiner* — Henok Legesse
(74) *Attorney, Agent, or Firm* — Cooper & Dunham LLP

(57) ABSTRACT

A liquid ejection head includes a nozzle formation member having a liquid repellent layer disposed on a droplet ejection face of a nozzle substrate in which one or more nozzle orifices is formed to eject droplets. The liquid repellent layer includes a first sub-layer and a second sub-layer. The first sub-layer contains a higher proportion of low-molecular-weight molecules than the second sub-layer. The second sub-layer contains a higher proportion of high-molecular-weight molecules than the first sub-layer. Both the first sub-layer and the second sub-layer are exposed on a surface of the nozzle formation member.

15 Claims, 21 Drawing Sheets

U.S. PATENT DOCUMENTS

| | | | |
|---|---|---|---|
| 2007/0229600 | A1 | 10/2007 | Hashimoto |
| 2007/0247026 | A1 | 10/2007 | Tsukamura et al. |
| 2007/0257968 | A1 | 11/2007 | Hashimoto et al. |
| 2008/0062226 | A1 | 3/2008 | Urasaki |
| 2008/0309734 | A1 | 12/2008 | Nishimura et al. |
| 2009/0058940 | A1 | 3/2009 | Fujii |
| 2009/0102907 | A1 | 4/2009 | Yamanaka et al. |

FOREIGN PATENT DOCUMENTS

| | | |
|---|---|---|
| JP | 2000-318163 | 11/2000 |
| JP | 2003-94665 | 4/2003 |
| JP | 3428616 | 5/2003 |
| JP | 2004-75739 | 3/2004 |
| JP | 2004-276568 | 10/2004 |
| JP | 2004-330681 | 11/2004 |
| JP | 2005-88357 | 4/2005 |
| JP | 2005-138383 | 6/2005 |
| JP | 2005271299 | 10/2005 |
| JP | 3755647 | 6/2006 |
| JP | 2007-144989 | 6/2007 |
| JP | 4000486 | 8/2007 |
| JP | 2007-276256 | 10/2007 |
| JP | 4087085 | 2/2008 |
| JP | 2008-213422 | 9/2008 |
| JP | 2008-221641 | 9/2008 |

* cited by examiner

LIQUID EJECTION HEAD, IMAGE FORMING APPARATUS EMPLOYING THE LIQUID EJECTION HEAD, AND METHOD OF MANUFACTURING THE LIQUID EJECTION HEAD

CROSS-REFERENCE TO RELATED APPLICATIONS

The present patent application claims priority pursuant to 35 U.S.C. §119 from Japanese Patent Application Nos. 2008-217494, filed on Aug. 27, 2008, and 2009-085614, filed on Mar. 31, 2009 in the Japan Patent Office, each of which is hereby incorporated herein by reference in its entirety.

BACKGROUND OF THE INVENTION

1. Field of the Invention

Illustrative embodiments of the present invention relate to a liquid ejection head, an image forming apparatus employing the liquid ejection head, and a method of manufacturing the liquid ejection head.

2. Description of the Background

Image forming apparatuses are used as printers, facsimile machines, copiers, plotters, or multi-functional peripherals having several of the foregoing capabilities. Known image forming apparatuses employing a liquid-ejection recording method include inkjet recording apparatuses, which eject liquid droplets from a recording head onto a sheet-like recording medium to form a desired image.

Such inkjet-type image forming apparatuses fall into two main types: a serial-type image forming apparatus that forms an image by ejecting droplets while moving a recording head in a main scan direction, and a line-head-type image forming apparatus that forms an image by ejecting droplets from a recording head fixedly disposed in the image forming apparatus.

Such a recording head (liquid ejection head) may include a pressure generator (actuator) that generates pressure on ink present in a plurality of channels (also referred to as pressure chambers or the like) corresponding to a plurality of nozzle arrays for ejecting ink droplets. Such a pressure generator may, for example, be a piezoelectric actuator including a piezoelectric element, a thermal actuator including a heating resistant, or an electrostatic actuator that generates electrostatic force.

Since the liquid ejection head ejects ink as droplets from the nozzles, the surface properties of a droplet ejection side of a nozzle formation face of a nozzle formation member (nozzle plate) on which the nozzles are formed, that is, a side of the nozzle formation face facing a recording sheet (hereinafter also simply "nozzle formation face"), greatly affects droplet ejection performance. For example, if ink is adhered to a peripheral portion of a nozzle, such adhered ink may cause failures such as an unstable droplet-ejection direction, a reduced nozzle diameter, a reduced droplet-ejection amount (droplet size), and/or an unstable droplet-ejection speed. For these reasons, generally, a liquid-repellent layer (also referred to as a water-repellent layer, an ink-repellent layer, or the like) is formed on the surface of the nozzle formation face to prevent ink from adhering to a nozzle peripheral portion and enhance the droplet ejection performance.

Meanwhile, one known image forming apparatus includes a maintenance-and-recovery mechanism that performs maintaining and recovery operations on a liquid ejection head at a certain timing to prevent nozzle clogging of the head. In the maintenance-and-recovery mechanism, since the nozzle formation face of the liquid ejection head is wiped with a wiper member for cleaning, the liquid ejection head needs a liquid-repellent layer capable of withstanding repeated wiping.

To obtain such durability and liquid repellency, generally, a fluorine-added eutectic plated film or an organic thin film is formed on the liquid-repellent layer, or the liquid-repellent layer is coated with a fluorine or silicone liquid-repellent agent.

For example, in one conventional technique, a plated film is formed by a eutectic reaction of an elliptical hard material and a fluorocarbon polymer. At this time, particles of the hard material protrude from the surface of the liquid-repellent film, enhancing the wiping durability (abrasion resistance) of the liquid-repellent film.

However, such a configuration results in a reduced proportion of a liquid-repellent group in the surface of the liquid-repellent film, causing an increased amount of residual ink to remain on the surface.

In another conventional technique, a thin film layer made of diamond-like carbon (DLC) having good adhesion to the nozzle plate is formed as a part of the liquid-repellent layer on the nozzle formation face of the nozzle plate to prevent peeling of the liquid-repellent layer. Further, a fluoride DLC layer is formed as a part of the liquid-repellent layer to give the nozzle formation face good liquid repellency. In such a configuration, two or more fluoride DLC layers containing different amounts of added fluorine may be formed. In such a case, a smaller amount of fluorine is added to the fluoride DLC layer closer to the DLC layer whereas a greater amount of fluorine is added to the fluoride DLC layer closer to the surface. Thus, the above-described technique attempts to obtain good liquid repellency and the preferred durability capable of maintaining the liquid-repellency by adding relatively large amounts of fluorine.

With the above-described configuration, since the DLC layer has properties similar to those of diamonds, relatively good resistance against scratches caused by wiping of the wiping member may be obtained. However, the DLC layer is relatively easily cracked or peeled by mechanical shock. Further, if there is a difference in coefficient of linear expansion between the liquid-repellent layer and the nozzle plate, for example, when the nozzle plate is bound to a channel member by raising the temperature during manufacture, tensile stress or compression stress may arise between the liquid-repellent layer and the nozzle plate, resulting in bending of the nozzle plate, or peeling or isolation of DLC.

In still another conventional technique, after an ink-repellent fluorocarbon polymer film is formed on the nozzle formation face, the fluorocarbon polymer film is hardened by heating in an inert gas or a vacuum. In such a case, a liquid material in the fluorocarbon polymer film is evaporated by heating, allowing hardening of the fluorocarbon polymer film and formation of a durable ink-repellent film. Further, heating in an inert gas or a vacuum may prevent oxidization of the fluorocarbon polymer film and binding of hydroxyl groups or hydrogen atoms to the fluorocarbon polymer film, allowing formation of an ink-repellent film having good ink repellency. However, such a configuration lacks the necessary durability (i.e., wiping resistance).

SUMMARY OF THE INVENTION

The present disclosure provides a liquid ejection head with enhanced liquid repellency and durability of a liquid-repellent layer of a nozzle formation member, an image forming apparatus employing the liquid ejection head, and a method of manufacturing the liquid ejection head.

In one illustrative embodiment, a liquid ejection head includes a nozzle formation member having a liquid repellent layer disposed on a droplet ejection face of a nozzle substrate in which one or more nozzle orifices is formed to eject droplets. The liquid repellent layer includes a first sub-layer and a second sub-layer. The first sub-layer contains a higher proportion of low-molecular-weight molecules than the second sub-layer. The second sub-layer contains a higher proportion of high-molecular-weight molecules than the first sub-layer. Both the first sub-layer and the second sub-layer are exposed on a surface of the nozzle formation member.

In another illustrative embodiment, an image forming apparatus includes a liquid ejection head. The liquid ejection head includes a nozzle formation member having a liquid repellent layer disposed on a droplet ejection face of a nozzle substrate in which one or more nozzle orifices is formed to eject droplets. The liquid repellent layer includes a first sub-layer and a second sub-layer. The first sub-layer contains a higher proportion of low-molecular-weight molecules than the second sub-layer. The second sub-layer contains a higher proportion of high-molecular-weight molecules than the first sub-layer. Both the first sub-layer and the second sub-layer are exposed on a surface of the nozzle formation member.

In still another illustrative embodiment, a method is disclosed of manufacturing a liquid ejection head including a nozzle substrate having two opposed faces, a chamber formation face and a droplet ejection face opposite the chamber formation face and in which one or more nozzle orifices are formed. The method includes forming a sacrificial layer made of metal or inorganic material on the chamber formation face of the nozzle substrate, forming a liquid-repellent film on the droplet ejection face of the nozzle substrate, and removing a portion of the liquid-repellent film adhering to an interior of the one or more nozzle orifices along with the sacrificial layer.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein:

FIG. 5(*b*) is a schematic section view illustrating the nozzle plate illustrated in FIG. 5(*a*);

FIG. 6(*b*) is a schematic plan view illustrating the surface of the liquid-repellent layer illustrated in FIG. 6(*a*);

Figure 1:
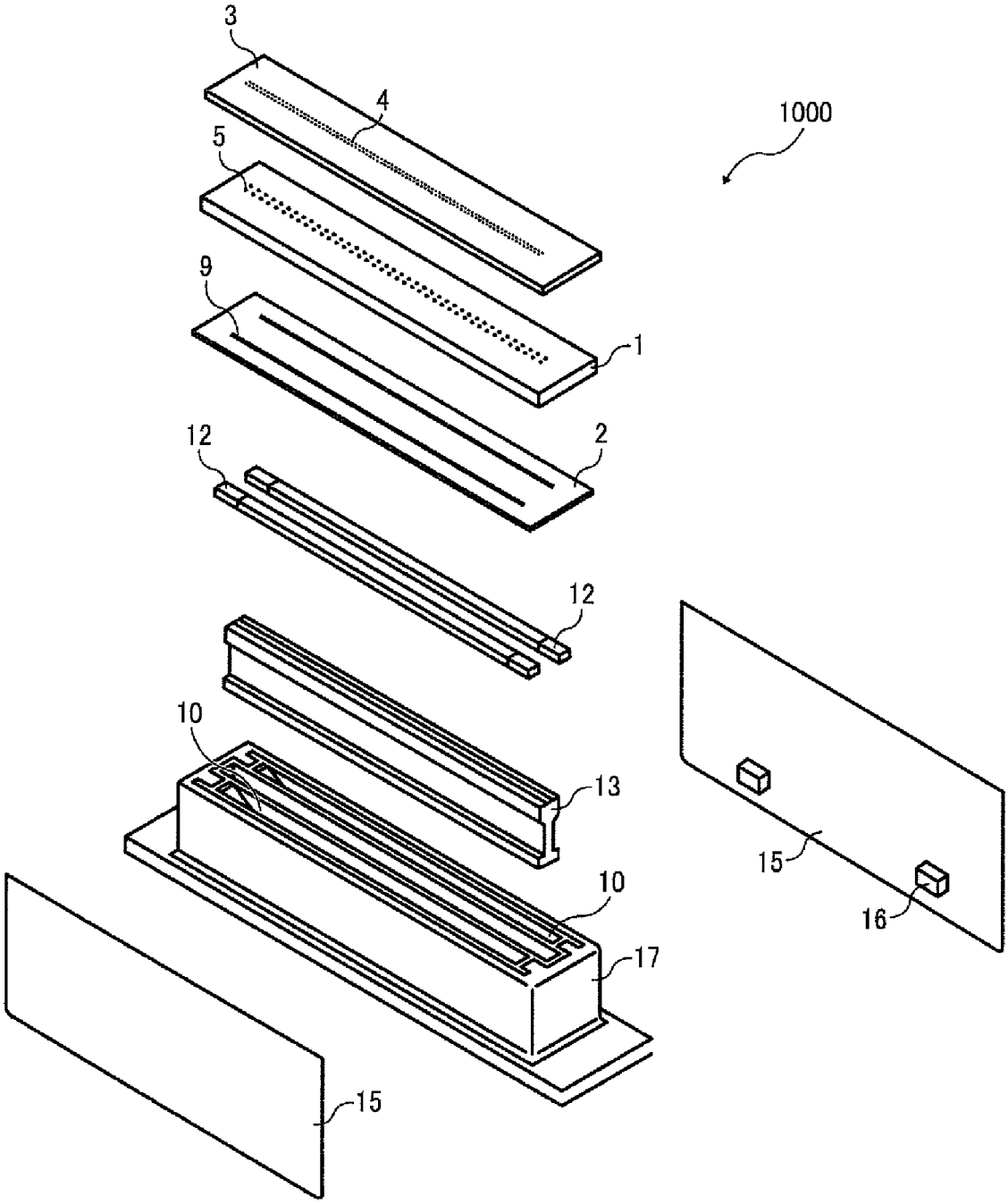
FIG. 1 is an exploded perspective view illustrating a liquid ejection head according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, the term "sheet" used herein refers to a medium, a recording medium, a recorded medium, a sheet material, a transfer material, a recording sheet, a paper sheet, or the like. The sheet may also be made of material such as paper, string, fiber, cloth, leather, metal, plastic, glass, timber, and ceramic. Further, the term "image formation" used herein refers to providing, recording, printing, or imaging an image, a letter, a figure, a pattern, or the like onto the sheet. Moreover, the term "liquid" used herein is not limited to recording liquid or ink, and may include anything ejected in the form of a fluid, such as DNA samples, resist, pattern material, washing fluid, storing solution, fixing solution. Hereinafter, such liquid may be simply referred to as "ink".

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present invention are described with reference to attached drawings.

Figure 2:
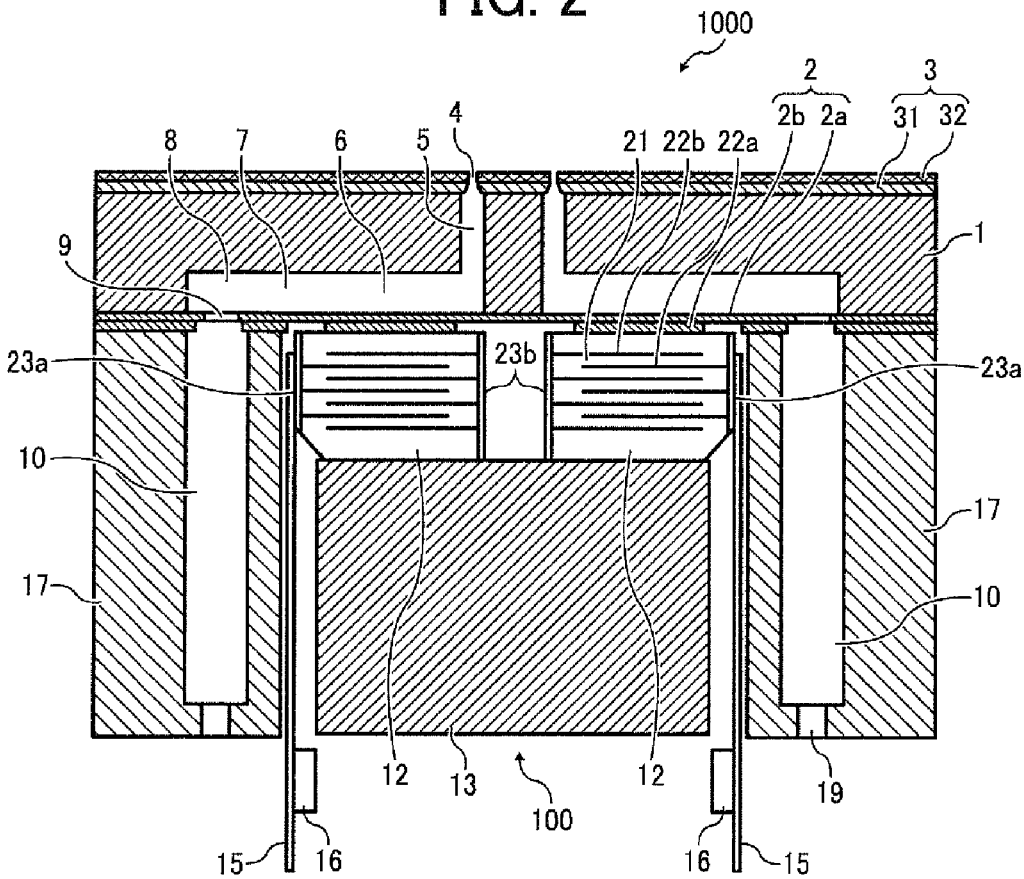
FIG. 2 is a section view illustrating the liquid ejection head illustrated in FIG. 1.
Figure 3:
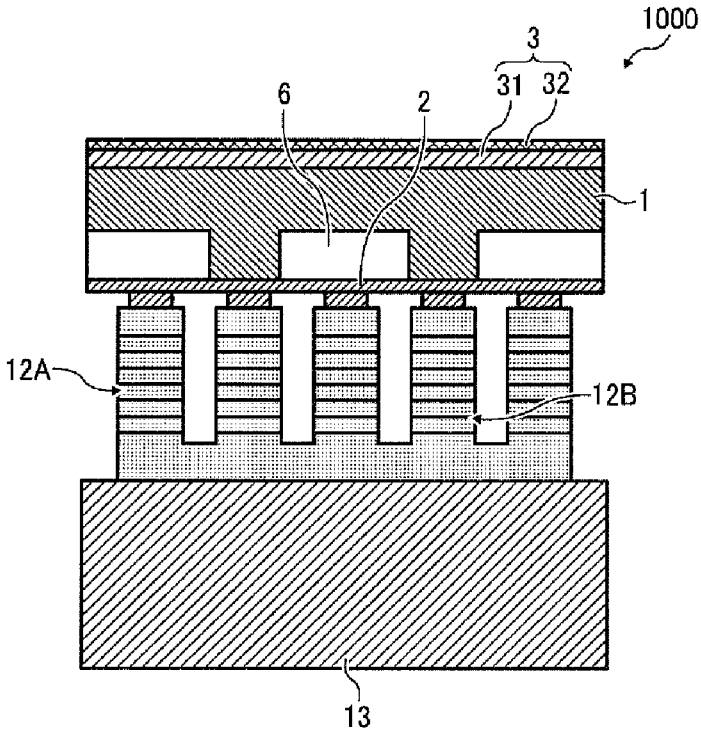
FIG. 3 is a section view illustrating an example of a bi-pitch structure of the liquid ejection head cut along a nozzle-array direction.
Figure 4:
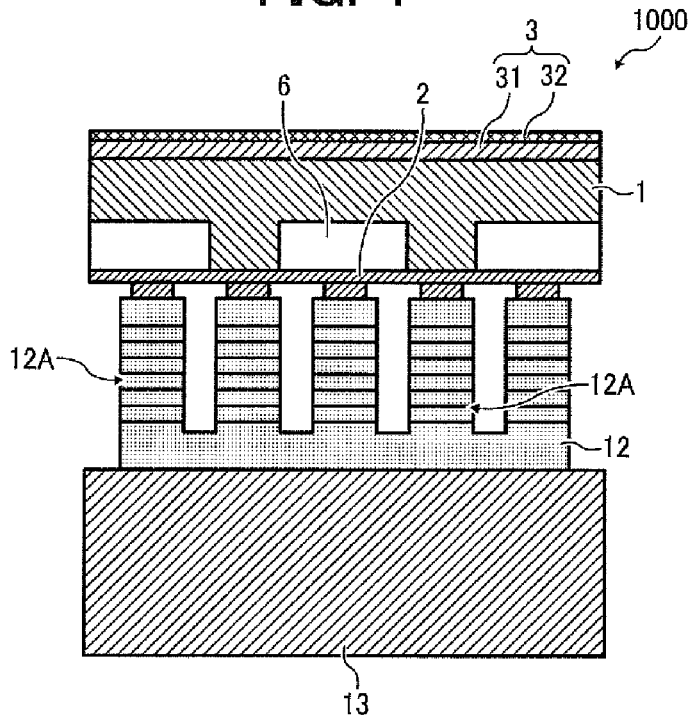
FIG. 4 is a section view illustrating an example of a normal pitch structure of the liquid ejection head cut along a nozzle-array direction.

First, a liquid ejection head 1000 according to a first illustrative embodiment is described with reference to FIGS. 1 to 4. FIG. 1 is an exploded perspective view illustrating the liquid ejection head 1000. FIG. 2 is a section view illustrating the liquid ejection head 1000 cut along a direction (i.e., a long direction of chamber) perpendicular to a nozzle-array direction (i.e., a short direction of chamber) of the liquid ejection head 1000. FIGS. 3 and 4 are section views illustrating different examples of the liquid ejection head 1000 cut along the nozzle-array direction.

The liquid ejection head 1000 includes a channel substrate (chamber substrate or channel member) 1, a diaphragm member 2 bonded to a lower face of the channel substrate 1, a nozzle plate 3 serving as a nozzle formation member bonded to an upper face of the channel substrate 1. The channel substrate 1, the diaphragm member 2, and the nozzle plate 3 form a plurality of chambers (pressure chambers, pressure rooms, or compression chambers) 6, fluid resistant portions 7, and connection portions 8. The plurality of chambers 6 serves as separate channels to which a plurality of nozzles 4 for ejecting liquid droplets is connected through corresponding connection paths 5. The fluid resistant portions 7 serve as supply paths that supply ink to the corresponding chambers 6, and the connection portions 8 are connected via the corresponding fluid resistant portion 7 to the chambers. Ink is supplied from common chambers 10 formed in a frame member 17 through supply ports 9 formed in the diaphragm member 2.

For the channel substrate 1, a silicon substrate is etched to form the connection paths 5, the chambers 6, and the fluid resistant portions 7. Alternatively, the channel substrate 1 may be formed by, for example, etching a SUS (stainless steel) substrate with acid etching solution or performing machining, such as punching or pressing, on it.

The diaphragm member 2 includes a plurality of vibration areas (diaphragm portions) 2*a* that form walls of the corresponding chambers 6 and convex portions 2*b* mounted on outer faces of the vibration areas 2*a*. On the convex portions 2*b* are bonded upper faces (bond faces) of respective piezoelectric pillars 12A and 12B of laminated piezoelectric elements 12. The lamination-type piezoelectric elements 12 serve as driving elements (actuators or pressure generators) that generate energy to deform the vibration areas 2*a* and eject liquid droplets. Lower faces of the piezoelectric elements 12 are bonded on a base member 13.

In each of the piezoelectric elements 12, a piezoelectric material layer 21 and one of internal electrodes 22*a* and 22*b* are alternately laminated. The internal electrodes 22*a* and 22*b* are drawn out to end faces, that is, side faces of each piezoelectric element 12 substantially perpendicular to the diaphragm member 2 and connected to end-face electrodes (external electrodes) 23*a* and 23*b*. Applying voltage to the end-face electrodes 23*a* and 23*b* causes displacement in a laminated direction of the piezoelectric elements 12. For the piezoelectric elements 12, a piezoelectric-element member is groove-processed by half-cut dicing to form a desired number of the piezoelectric-element pillars 12A and 12B.

The piezoelectric-element pillars 12A and 12B of the piezoelectric elements 12 have substantially identical configurations except that a driving waveform is applied to the piezoelectric-element pillar 12A to drive it while no driving waveform is applied to the piezoelectric-element pillar 12B so that the piezoelectric-element pillar 12B is used as a stationary pillar. In such a case, any of a bi-pitch structure as illustrated in FIG. 3 in which the piezoelectric-element pillars 12A and 12B are alternately arranged and a normal-pitch structure as illustrated in FIG. 4 in which all piezoelectric-element pillars are used as the piezoelectric-element pillars 12A may be employed.

Thus, the plurality of the piezoelectric-element pillars 12A serving as driving elements are arranged in two lines on the base member 13.

In the present illustrative embodiment, as the piezoelectric direction of the piezoelectric element 12, displacement in a d33 direction of the piezoelectric element 12 is used to pressurize ink in the chamber 6. Alternatively, displacement in a d31 direction may be used to pressurize ink in the chamber 6.

It is to be noted that the material of piezoelectric element is not limited to a material of the piezoelectric element 12 according to the present illustrative embodiment and may be an electromechanical transducer element, such as a ferroelectric of $BaTiO_3$, $PbTiO_3$, $(NaK)NbO_3$, or the like, which is generally used as the material of piezoelectric element. Further, it is to be noted that, although the lamination-type piezoelectric element is employed in the present illustrative embodiment, for example, a single-plate-type piezoelectric element may be employed. The single-plate-type piezoelectric element may be formed by cutting processing. Alternatively, the single-plate-type piezoelectric element may be a thick film formed by screen printing and sintering or a thin film formed by sputtering, depositing, or sol-gel processing. The lamination-type piezoelectric elements 12 may be arranged in one line or a plurality of lines on the base member 13.

An FPC (flexible printed circuit) 15 with a wiring pattern is directly connected to the external electrode 23*a* of each of the piezoelectric-element pillars 12A of the piezoelectric elements 12 via a soldering member to transmit a drive signal to the external electrode 23*a*. The FPC 15 includes a driving circuit (driver IC) 16 that selectively applies a driving waveform to each piezoelectric-element pillar 12A. The external electrodes 23*b* of the piezoelectric-element pillars 12A are electrically connected to a common wiring of the FPCs 15 by soldering members. In the present illustrative embodiment, output terminals bonded to the piezoelectric elements 12 are solder-coated, thus allowing solder bonding. Alternatively, instead of the FPCs 15, the piezoelectric elements 12 may be solder-coated. Further, as the bonding method, anisotropic conductive-film bonding or wire bonding may be employed instead of solder boding.

The nozzle plate 3 includes a nozzle substrate 31 and a liquid-repellent layer 32. In the nozzle substrate 31, the nozzles 4 having a diameter of from approximately 10 to 35 μm are formed corresponding to the respective chambers 6. The liquid-repellent layer 32 is formed on a droplet-ejection face (nozzle formation face) of the nozzle substrate 31 (opposite a face facing the cambers 6).

A piezoelectric actuator unit 100 includes the piezoelectric elements 12 implemented with (connected to) the FPCs 15 and the base member 13. To an outer circumference of the piezoelectric actuator unit 100 is provided a frame member 17 that is formed by injection molding of, for example, epoxy resin or polyphenylene sulfite. The above-mentioned common chambers 10 are formed in the frame member 17. Supply ports 19 are provided to the common chambers 10 to supply ink from external ink-supply sources to the common chambers 10 and connected to the ink-supply sources, such as ink cartridges and sub tanks, which are not illustrated.

In the liquid ejection head having such a configuration, for example, by lowering a voltage applied to one piezoelectric-element pillar 12A below a reference electric potential, the piezoelectric-element pillar 12A contracts, thus depressing the corresponding vibration area 2*a* of the diaphragm member 2. As a result, the volume of the corresponding chamber 6 expands, causing ink to flow into the chamber 6. Then, the voltage applied to the piezoelectric-element pillar 12A is raised to extend the piezoelectric-element pillar 12A in the laminated direction. As a result, the diaphragm member 2 is deformed in the droplet-ejection direction of the nozzle 4 to reduce the volume of the chamber 6. Accordingly, ink in the chamber 6 is pressurized and ejected (jetted) as ink droplets from the nozzle 4.

Further, by returning the voltage applied to the piezoelectric-element pillar 12A to the reference potential, the vibration area 2*a* of the diaphragm member 2 returns to the initial position, expanding the chamber 6 and generating negative pressure. As a result, ink is supplied from the common chamber 10 to the chamber 6. When the vibration of a meniscus face of the nozzle 4 decays and stabilizes, operation for the next droplet ejection is started.

It is to be noted that the driving method of the liquid ejection head is not limited to the above-described example (pull-push ejection) and may be selected from a plurality of driving methods, such as pull-push ejection and push-pull ejection, in accordance with the way in which a driving waveform is applied.

Figure 5:
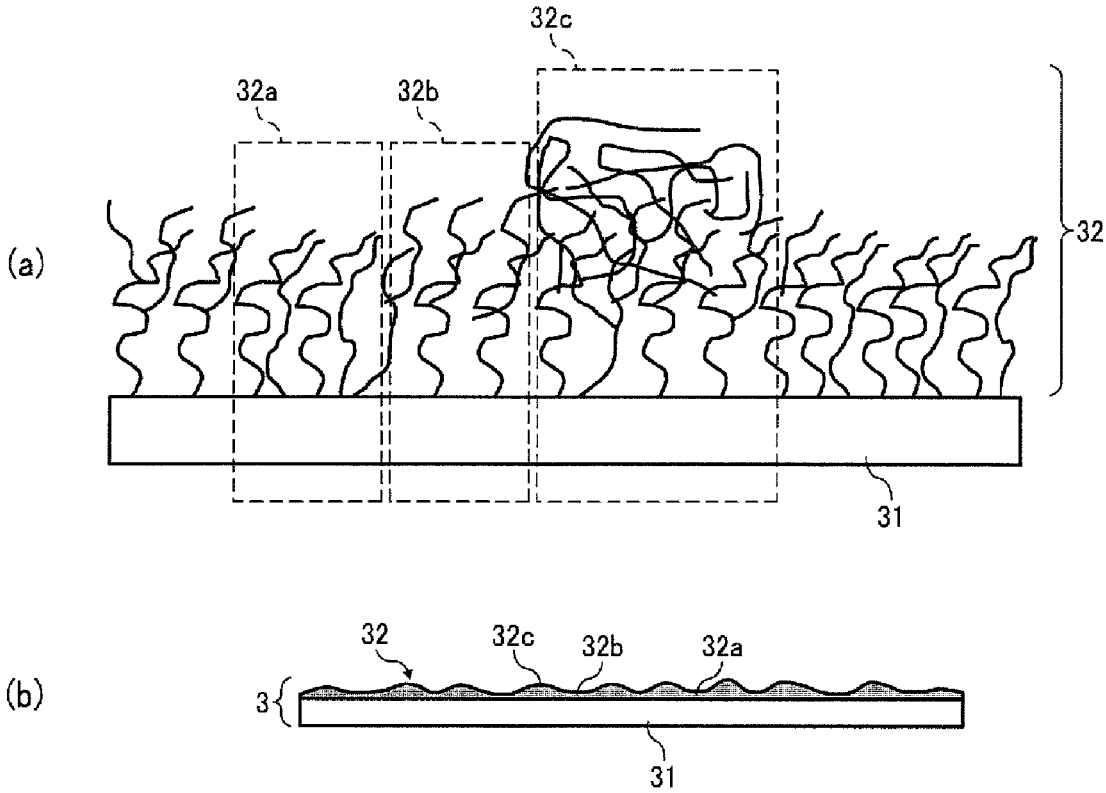
FIG. 5(*a*) is a schematic view illustrating a liquid-repellent layer of a nozzle plate of the liquid ejection head.

Next, the nozzle plate 3 of the liquid ejection head 1000 is described in detail with reference to FIGS. 5(*a*) and 5(*b*). FIG. 5(*a*) is a schematic view illustrating the liquid-repellent layer 32 of the nozzle plate 3. FIG. 5(*b*) is a schematic section view illustrating the nozzle plate 3.

As described above, the liquid-repellent layer 32 is formed on the droplet-ejection face of the nozzle substrate 31 in the nozzle plate 3. The liquid-repellent layer 32 further includes at least two layers having different degrees of liquid-repellency formed in an exposed state on a surface of the nozzle plate 3.

In this illustrative embodiment, the liquid-repellent layer 32 is made of fluorocarbon resin and includes a mono-molecular layer 32*a*, a dimeric layer 32*b*, a multimeric or copolymer (molecular-chain) intertwined layer 32*c* (hereinafter, simply referred to as "multimeric layer 32*c*"). The mono-molecular layer 32*a*, the dimeric layer 32*b*, and the multimeric layer 32*c* are formed exposed on the surface of the nozzle plate 3. The multimeric layer 32*c* is not laminated independently of the mono-molecular layer 32*a* and the dimeric layer 32*b*. In other words, a portion of the multimeric layer 32*c* is intertwined with the mono-molecular layer 32*a* or the dimeric layer 32*b*.

A fluorine-containing organic material capable of forming such a layer structure is, for example, an organic macromolecule that is a polymer or copolymer of unit monomer containing one or more fluorine atoms on average and has film forming capability. Such a fluorine-containing organic material is, for example, polytetrafluoroethylene (PTFE), tetrafluoroethylene-perfluoro(alkyl vinyl ether) copolymer (PFA), tetrafluoroethylene-hexafluoropropylene-perfluoro (alkyl vinyl ether) copolymer, tetrafluoroethylene-hexafluoropropylene copolymer, tetrafluoroethylene-ethylene copolymer, trifluorochloroethylene polymer, trifluorochloroethylene-ethylene copolymer, polyvinyl fluoride, polyvinylidene fluoride, fluoro polyether copolymer, fluoropolyether polymer, polyfluorosilicone, and perfluoro polymer having an aliphatic ring structure.

In the above-mentioned fluorine-containing organic materials, perfluoro-type polymer or copolymer may be preferred. It may be further preferred that at least one double-bond or triple-bond carbon, —COOH group, or —$Si(OR)_3$ group (in which R represents alkyl of from one to three carbons) is contained in molecule. The liquid-repellent layer 32 formed with such a perfluoro-type polymer or copolymer has excellent adhesion to the nozzle substrate 31.

Such a preferred fluorine-containing organic material is, for example, a perfluoro polyether (which is commercially available, for example, under a trade name "OPTOOL DSX" manufactured by Daikin Industries, ltd) or amorphous perfluoro polymer having an aliphatic ring structure in the main chain.

In this regard, a method of manufacturing the liquid-repellent layer 32 having the above-mentioned structure using such a fluorine-containing organic material is described later.

The liquid-repellent layer 32 may be a thin film of approximately 50 to 2,000 nm and may preferably be approximately 100 to 200 nm. The difference in film thickness between the mono-molecular layer 32*a*, the dimeric layer 32*b*, and the multimeric layer 32*c* may be 2 nm to 200 nm, preferably 10 nm to 100 nm, which can provide apparent differences in physical properties between those layers.

Considering the mono-molecular layer 32*a*, the dimeric layer 32*b*, and the multimeric layer 32*c* forming the liquid-repellent layer 32 as a bulk, the lower the molecular weight (e.g., the mono-molecular layer 32*a* and the dimeric layer 32*b*), the higher the liquid repellency. Further, the higher the molecular weight (e.g., the multimeric layer 32*c*), the higher the durability. In such a higher-molecular-weight layer, some linear-chain copolymers bind to each other and other linear-chain copolymers just intertwine each other. Such a configuration provides a certain degree of freedom in molecular chains. Accordingly, the higher-molecular-weight layer has a preferred slidability (high durability) to the wiping by a wiper member, further enhancing the durability of the liquid-repellent layer 32.

As described above, in the liquid-repellent layer, at least one lower-molecular-weight layer and at least one higher-molecular-weight layer are laminated, and both the lower-molecular-weight layer and the higher-molecular-weight layer are formed exposed on the surface of the nozzle formation member (nozzle substrate). Such a configuration enhances both the durability and liquid-repellency of the liquid-repellent layer.

That is, the liquid-repellent layer is formed by laminating two or more layers that are formed exposed on the surface of the nozzle formation member. A first layer of the two or more layers has relatively high liquid repellency as compared with a second layer of the two or more layers. The second layer has relatively high durability against the wiping by the wiping member as compared with the first layer. Such a configuration enhances both the durability and liquid-repellency of the liquid-repellent layer.

Further, forming the liquid-repellent layer with a fluorine compound provides enhanced water and oil repellency and/or an excellent antifouling effect.

Figure 6:
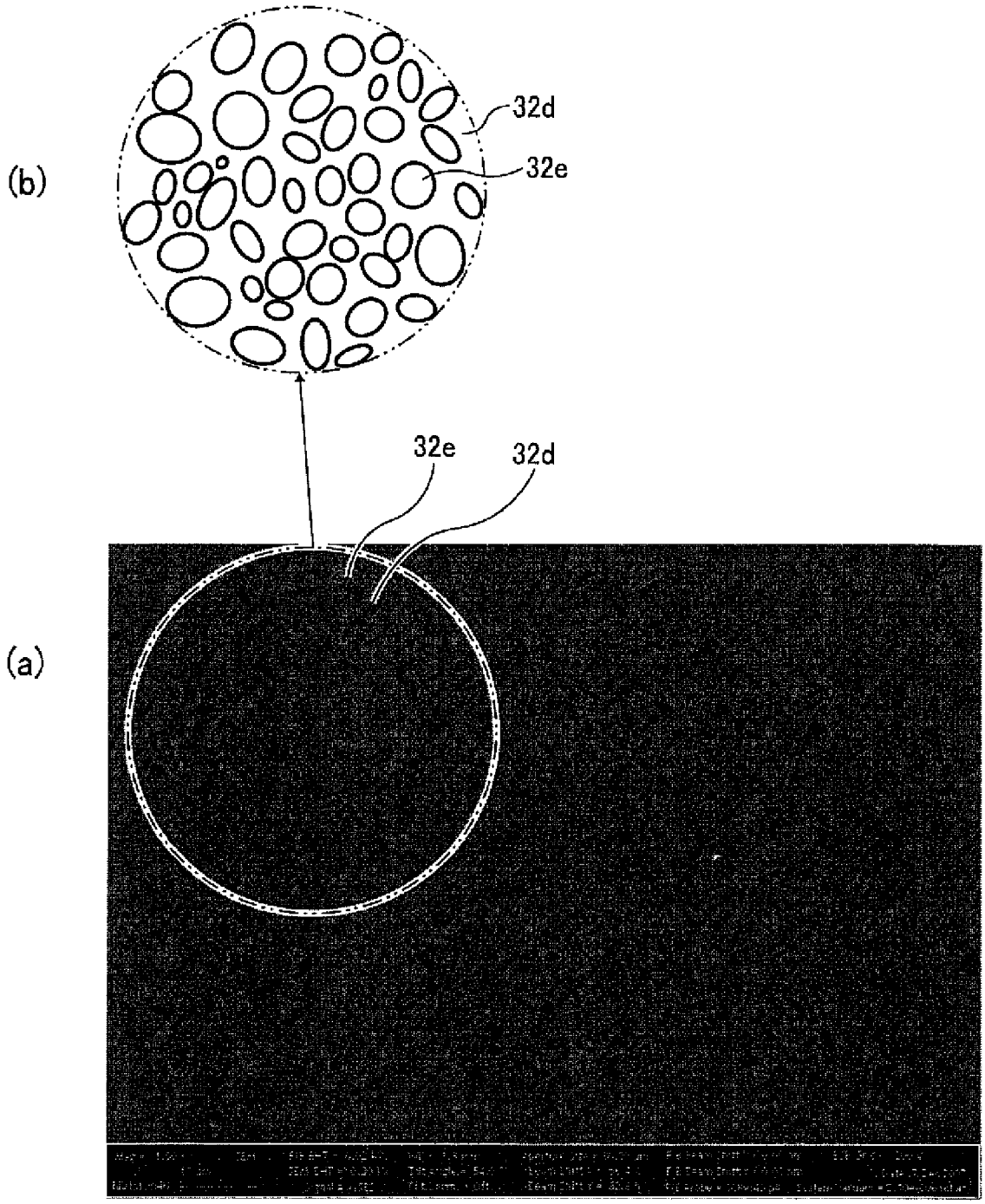
FIG. 6(*a*) is a graphic image showing a surface of a liquid-repellent layer of the nozzle plate shot by an electron microscope.

Next, a nozzle plate of a liquid ejection head 1000 according to a second illustrative embodiment of the present disclosure is described with reference to FIG. 6. FIG. 6(*a*) is a graphic image showing a surface of a liquid-repellent layer of the nozzle plate shot by an electron microscope. FIG. 6(*b*) is a schematic plan view illustrating the surface of the liquid-repellent.

In the present illustrative embodiment, a high-molecular layer 32*e* is scattered in island shapes on a low-molecular layer 32*d* that is formed across a nozzle plate member.

The low-molecular layer 32*d* consists of mono-molecules or several molecules and has an end portion that binds to the nozzle substrate. In the low-molecular layer 32*d*, straight-chain molecules having repellent groups exist in a rice-ear shape, providing excellent liquid-repellency. In the high-molecular layer 32*e* scattered in island shapes, molecular chains intertwine each other and partly bind to each other, providing excellent liquid-repellency and durability. The island portions of the high-molecular layer 32*e* are randomly scattered on the surface of the nozzle plate. Such a configuration prevents uneven wear by the wiper member, thus preventing reduction in the cleaning performance.

Figure 7:
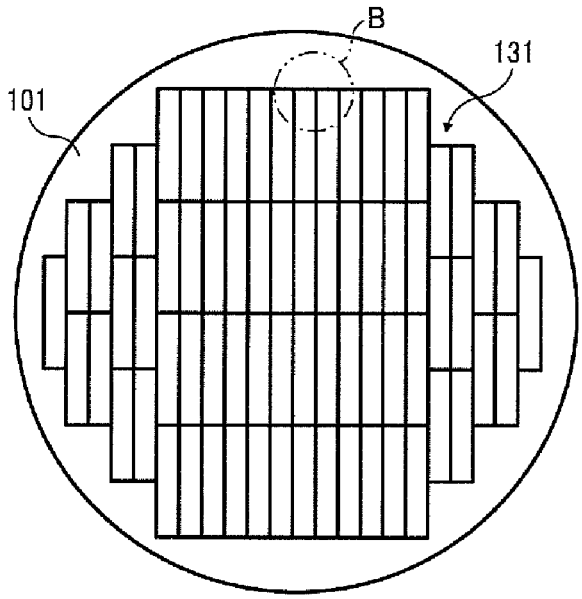
FIG. 7 is a plan view illustrating an example of an arrangement pattern of a plurality of nozzle substrates on a silicon plate.
Figure 8:
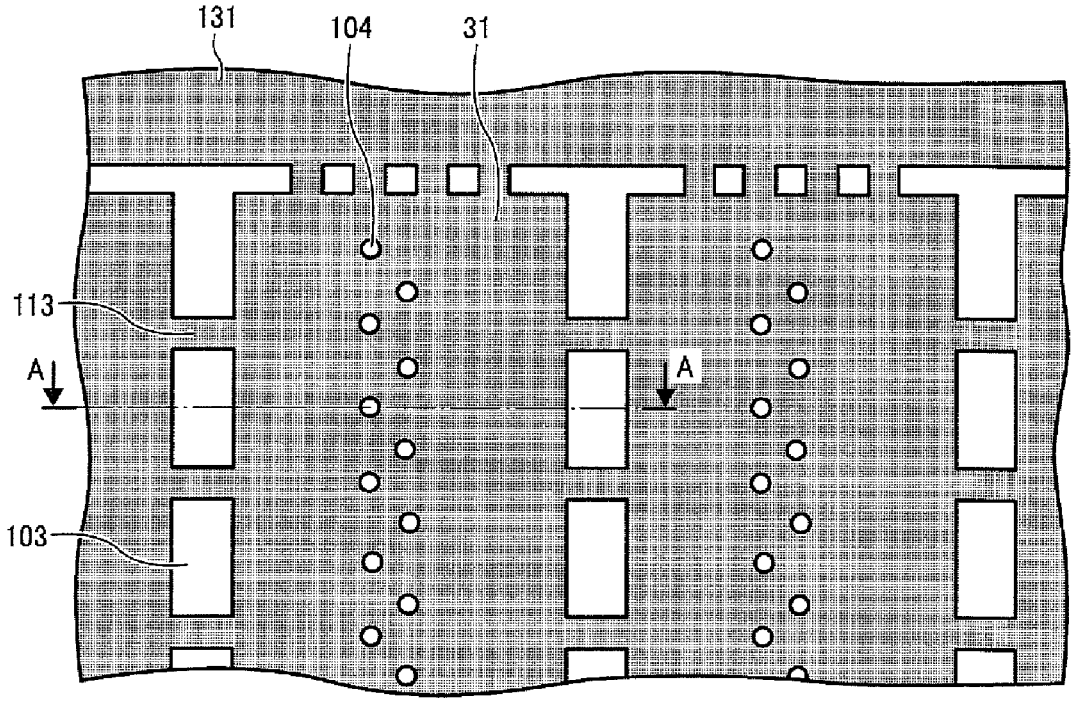
FIG. 8 is an enlarged view of a portion B illustrated in FIG. 7.
Figure 9:
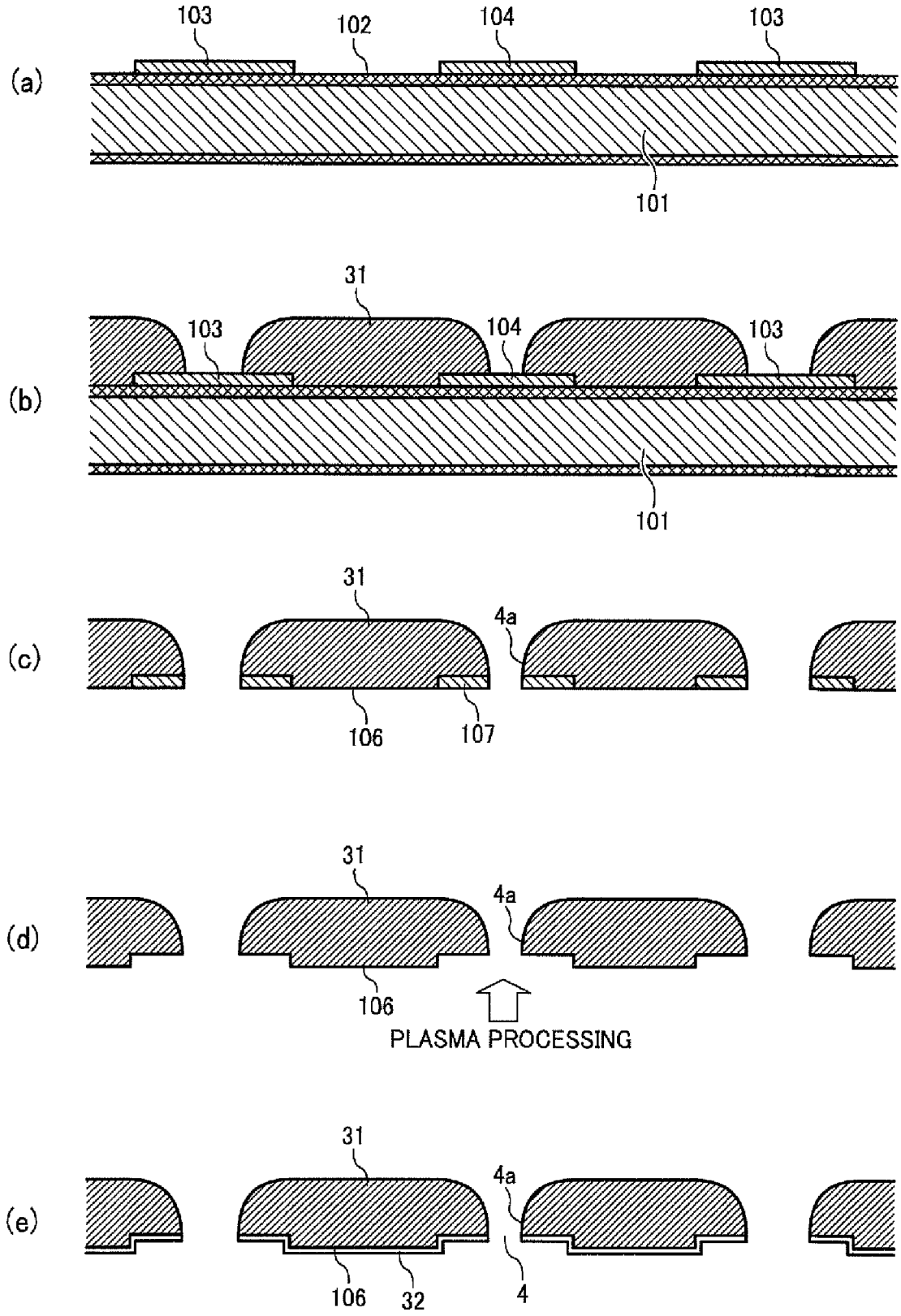
FIGS. 9(*a*) to 9(*e*) are section views illustrating a manufacturing process of the nozzle plate cut along a line A-A illustrated in FIG. 8.

Next, one example of the method of manufacturing a nozzle plate according to any of the above-described illustrative embodiments is described with reference to FIGS. 7 to 9. FIG. 7 is a plan view illustrating an example of an arrangement pattern of a plurality of nozzle substrates on a silicon substrate. FIG. 8 is an enlarged view of a portion B illustrated in FIG. 7. FIGS. 9(*a*) to 9(*e*) are section views illustrating a manufacturing process of the nozzle plate cut along a line A-A illustrated in FIG. B.

As illustrated in FIG. 9(*a*), for example, a Ti (titanium) film 102 is formed with a thickness of 1000 Å on a silicon substrate 101 by a sputter device. A nozzle-orifice formation pattern 104 for forming nozzle orifices on the Ti film 102 and a chip separation pattern 103 for separating respective nozzle plates 3 are formed by applying, exposing, and developing a photosensitive material.

Then, as illustrated in FIG. 9(*h*), Ni is precipitated on the Ti film 102 by Ni electroforming to form a nozzle substrate 31. At this time, as illustrated in FIGS. 7 and 8, a sheet member 131 of multiple nozzle substrates 31 segmented with the chip separation pattern 103 and connected with each other via bridge portions 113 is formed on one silicon substrate 101.

Further, as illustrated in FIG. 9(*c*), the sheet member 131 of the nozzle substrates 31 is separated from the silicon base member 101, thus providing the nozzle substrates 31 in which the nozzle orifices 4*a* partly constituting the nozzles 4 have been formed. At this time, a resist 107 forming the nozzle-orifice formation pattern 104 and the chip separation pattern 103 adheres to a nozzle formation face 106 of each nozzle substrate 31.

As illustrated in FIG. 9(*d*), oxygen-plasma processing is performed on the nozzle formation face 106 of the nozzle substrates 31 to remove the resist 107 remaining on the nozzle formation face 106. Thus, formation of the nozzle orifices 4*a* and the chip separation pattern 103 in the nozzle substrates 31 are finished.

As illustrated in FIG. 9(*e*), a liquid-repellent layer 32 is formed on the nozzle formation face 106 of each nozzle substrate 31. However, it is to be noted that the film formation method is not limited to vapor deposition and may be dipping, spin coating, dispensing, or the like. As the material of the liquid-repellent layer 32, a fluorine-containing organic material may be employed. For example, a perfluoro polyether having —$Si(OR)_3$ group at an end portion in the main chain may be employed as described below.

Then, the bridge portions 113 of the nozzle sheet illustrated in FIG. 8 are cut into separate nozzle plates 3 with scissors or a cutter.

Next, a description is given of a method of forming the nozzle substrates 31 from the fluorine-containing-resin thin film (the liquid-repellent layer 32) on by vapor deposition.

(1) Degreasing wash of the nozzle substrate 31: the nozzle substrate 31 to be coated is washed in advance. Washing with organic solvent, such as acetone, brush-washing with isopropyl alcohol (IPA), or ultrasonic washing is performed in accordance with the type of the nozzle substrate 31.

(2) Setting of a target and the nozzle substrates 31: as a fluorine-containing organic material, a perfluoro polyether having —$Si(OR)_3$ group at an end portion of the main chain is filled into a deposition boat made of alumina coated basket type, and the nozzle substrates 31 to the deposition boat are mounted with the nozzle formation face 106 up.

(3) Exhaustion of a film formation device: air is exhausted until the internal pressure of the film formation device reaches, for example, 10-2 to 10-4 Pa. It may be preferred to exhaust air until the internal pressure is below 5×10-3 Pa.

(4) Formation of the fluorine-containing organic material: the electric current of the deposition boat is set to 5A, and the deposition boat is heated to 50° C. to remove the solvent. Then, the electric current is raised to 10A, and the temperature is raised to 400° C. and held for three minutes.

The above-described deposition conditions are set so that the deposition amount of the above-described material becomes relatively excess as compared with a typical deposition condition of the material. Accordingly, the nozzle substrate 31 is covered by a mono-molecular layer 32*a* and a dimeric layer 32*b*. The dimeric layer 32*b* is covered with a multimeric layer 32*c*, which is not generally used as a liquid repellent layer because of low repellency.

However, since the multimeric layer 32*c* does not directly bind the nozzle substrate 31 and fluidizes under the deposition settings, the multimeric layer 32*c* is repelled by the monomolecular layer 32*a* and the dimeric layer 32*b* having relatively high repellency and, as a result, scattered as droplets. Accordingly, the monomolecular layer 32*a* and the dimeric layer 32*b* are exposed on an area at which the multimeric layer 32*c* is repelled.

Using the above-described manufacturing method, a fluorine-containing-resin thin film is formed on the nozzle formation face of the nozzle substrate 31 as the liquid-repellent layer 32. Thus, the above-described multilayer structure including the monomolecular layer 32*a*, the dimeric layer 32*b*, and the multimeric layer 32*c* is formed, providing the liquid-repellent layer 32 in which the respective layers 32*a*, 32*b*, and 32*c* are exposed on the nozzle formation face.

In this regard, the fluorine-containing organic material may be partly reacted in advance and deposited at the partly reacted state. In such a case, the above-mentioned low-molecular-weight layers (the monomolecular layer 32*a* and the dimeric layer 32*b*) and the high-molecular-weight layer (the multimeric layer 32*c*) can be easily obtained, allowing reduction of production cost.

Here, a description is given of a difference between the liquid-repellent layer 32 formed by the above-described deposition method and a conventional liquid-repellent layer containing the above-described perfluoro polyether having —$Si(OR)_3$ group at an end of the main chain.

Conventionally, a liquid-repellent layer containing OPTOOL DSX has a configuration in which a silane-coupling material binds a base material in a rice-ear form so that the fluorine-compound main chains nods, which corresponds to the configuration of the monomolecular layer 32*a* having relatively high liquid-repellency. Therefore, in the manufacturing method, the deposition amount is controlled to be small, and unreacted material not binding to the base member after the deposition is removed when forming a liquid-repellent layer. By contrast, in the present illustrative embodiment, not only are multimeric molecules formed in the liquid-repellent layer 32 but deposition is excessively performed until multimeric molecules fluidize in droplet shapes. Thus, both the mono-molecules and multimeric molecules are exposed on the surface (or multimeric molecules are scattered in island shapes). In the manufacturing process, unreacted material (the multimeric layer 32*c*) on the surface of a film formed by vapor deposition is left without being removed, and is used as a liquid-repellent film. Such a concept that unreacted material is left on the surface of a liquid-repellent layer is not known in conventional arts.

Figure 10:
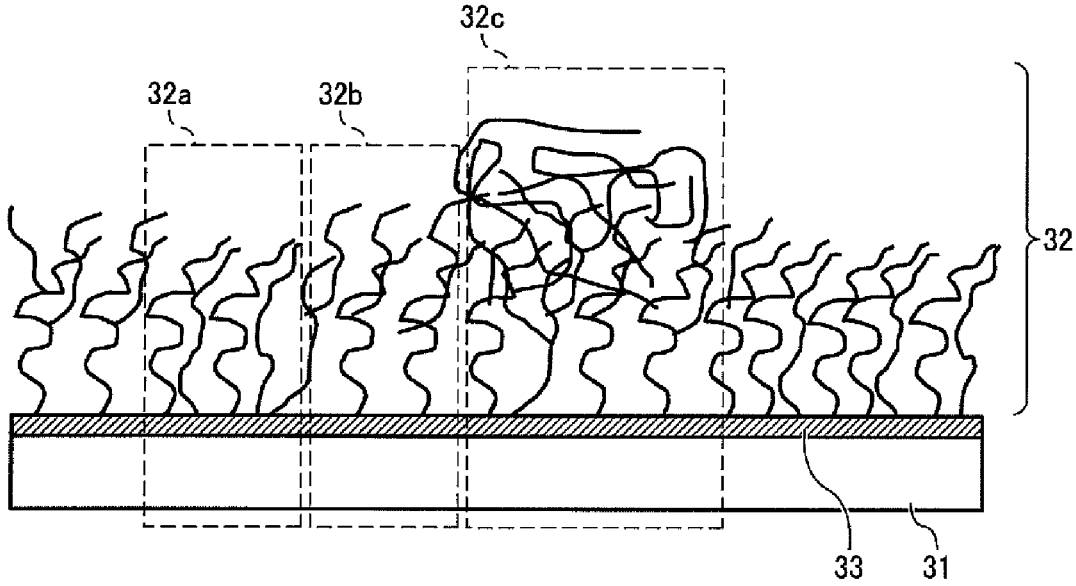
FIG. 10 is a schematic view illustrating a liquid-repellent layer of a nozzle plate in a liquid ejection head according to an illustrative embodiment.

Next, a nozzle plate of a liquid-ejection head according to a third illustrative embodiment is described with reference to FIG. 10. FIG. 10 is a schematic view illustrating a liquid-repellent layer of the nozzle plate.

In FIG. 10, an inorganic oxide layer 33 containing inorganic oxide, such as $SiO_2$, is formed between a nozzle substrate 31 and a liquid-repellent layer 32. Thus, forming an inorganic oxide film as an intermediate layer between a nozzle substrate and a liquid-repellent layer provides enhanced adhesion and durability of the liquid-repellent layer.

The inorganic oxide layer 33 containing $SiO_2$ is formed between the nozzle substrate 31 and the liquid-repellent layer 32 by, for example, the following method.

(1) Vacuum deposition: $SiO_2$ is evaporated in vacuum to form a thin film on the nozzle formation face of the nozzle substrate 31. Alternatively, Si is evaporated and passed through $O_2$ plasma to form dielectric substance on the nozzle substrate 31.

(2) Oxide sputtering: atoms or clusters of $SiO_2$, a target material, are hit out by Ar plasma or the like to form a thin film on the nozzle substrate 31.

(3) Reactive sputtering: Si target is oxidized in reactive gas containing oxygen to form a thin film on the nozzle substrate 31.

(4) Meta-mode sputtering: formation of a metal thin layer by sputtering with Si target and oxidization at a separate zone are repeated while rotating the nozzle substrate 31 to form a thin layer of $SiO_2$.

For example, the $SiO_2$ layer 33 is formed by the meta-mode sputtering, and in the same chamber, fluorine repellent agent is deposited on the $SiO_2$ layer 33 to form the liquid-repellent layer 32. In such a case, the thickness of the $SiO_2$ layer 33 may be preferred in a range of approximately 200 Å to 2000 Å.

Figure 11:
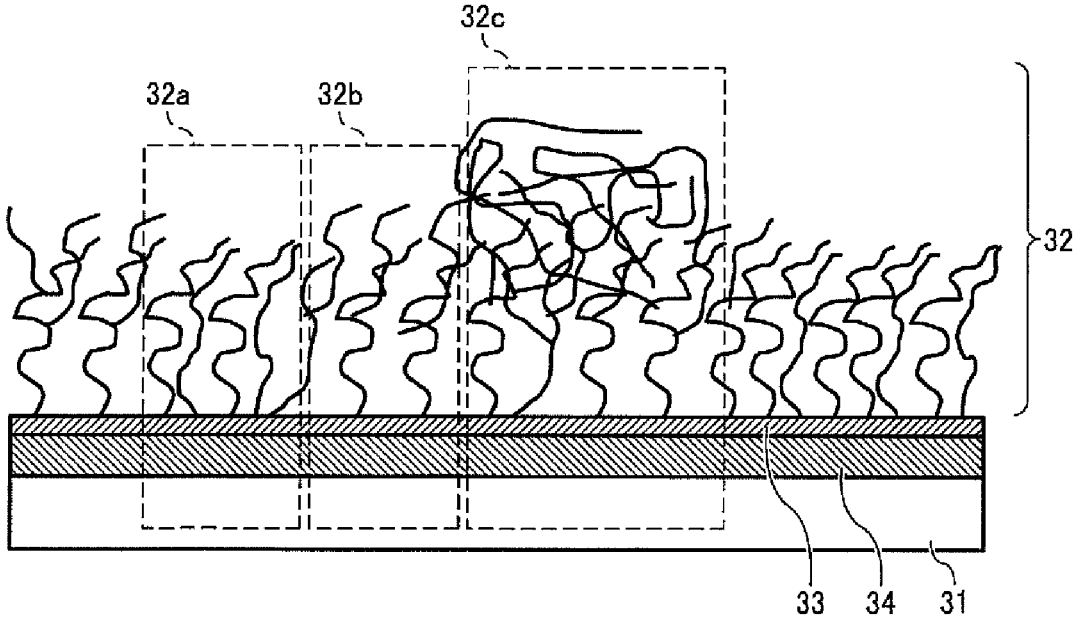
FIG. 11 is a schematic view illustrating a liquid-repellent layer of a nozzle plate in a liquid ejection head according to an illustrative embodiment.

Next, a nozzle plate of a liquid ejection head according to a fourth illustrative embodiment is described with reference to FIG. 11. FIG. 11 is a schematic view illustrating a liquid-repellent layer of the nozzle plate.

In FIG. 11, a metal layer 34 having a relatively-low free energy of generating oxide as compared with a nozzle substrate 31 is formed between the nozzle substrate 31 and an inorganic oxide layer 33. The metal layer 34 is made of, for example, Al, Cr, Zr, Ti, W, Fe, Mo, Mg, or Sn. Thus, the metal layer 34 is formed between the nozzle substrate 31 and an intermediate layer (e.g., the inorganic oxide layer 33) to which a liquid-repellent layer 32 binds, providing enhanced adhesion and durability of the liquid-repellent layer 32.

For example, meta-mode sputtering may be performed on Ti and $SiO_2$ in a single chamber, and the metal layer 34 having an oxide-formation free energy lower than the nozzle substrate 31, the inorganic oxide layer 33, and the liquid-repellent layer 32 containing the fluorine liquid-repellent agent may be formed in this order. In such a case, the thickness of Ti film may be preferably set to approximately 50 Å to 1,000 Å.

Figure 12:
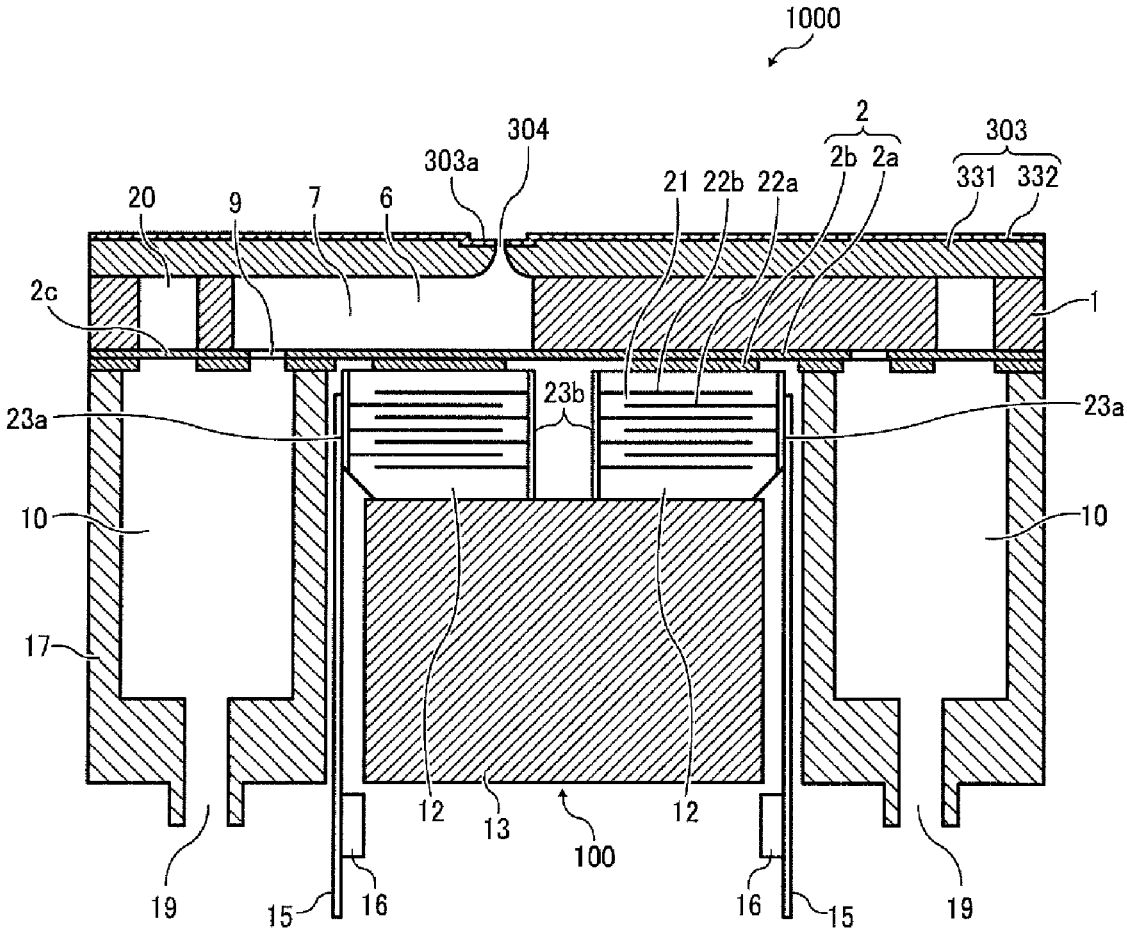
FIG. 12 is a section view illustrating a liquid ejection head according to an illustrative embodiment.

Next, a liquid ejection head 1000 according to a fifth illustrative embodiment is described with reference to FIG. 12.

The liquid ejection head 1000 employs a nozzle plate 303 instead of the nozzle plate 3 of the liquid ejection head 1000 according to the first illustrative embodiment. In the nozzle plate 303, concave portions 303*a* are formed around nozzles 304. A channel member 1 is made from a SUS substrate. The diaphragm member 2 includes vibration areas 2*a* made from resin films and convex portions 2*b* made of metal plates. The vibration areas 2*a* and the convex portions 2*b* are formed by laminating a macromolecule film, such as polyimid (PI) or polyphenylene sulfide (PPS) resin, and a rolled metal plate and etching the rolled metal plate. In the channel member 1 are formed damper rooms 20 communicated with the common chambers 10 via damper areas 2*c* of the diaphragm member 2. For other components, the liquid ejection head 1000 according to the present illustrative embodiment has substantially the same configuration as the configuration of the first illustrative embodiment. Therefore, the same reference numerals are allocated to components substantially identical to those of the first illustrative embodiment, and redundant descriptions thereof are omitted for the sake of simplicity.

Figure 13:
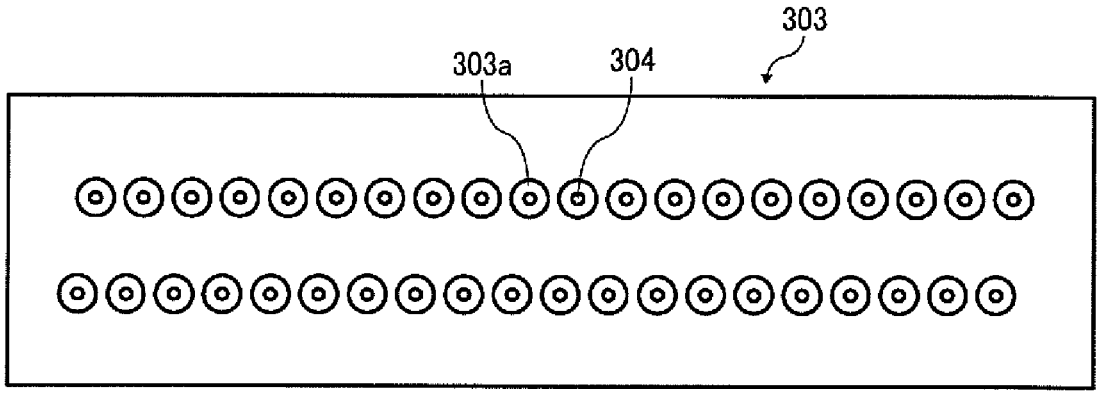
FIG. 13 is a plan view illustrating a nozzle plate of a liquid ejection head illustrated in FIG. 12.
Figure 14:
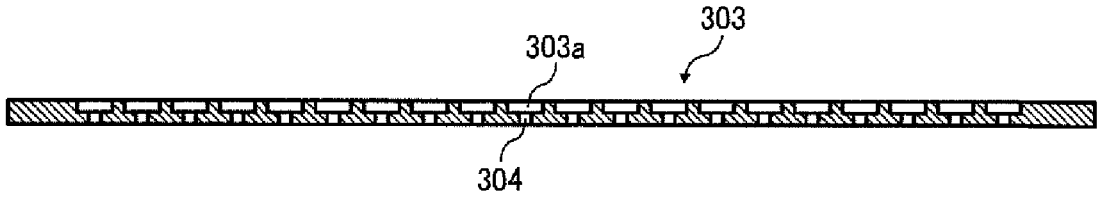
FIG. 14 is a section view illustrating the nozzle plate illustrated in FIG. 13.
Figure 15:
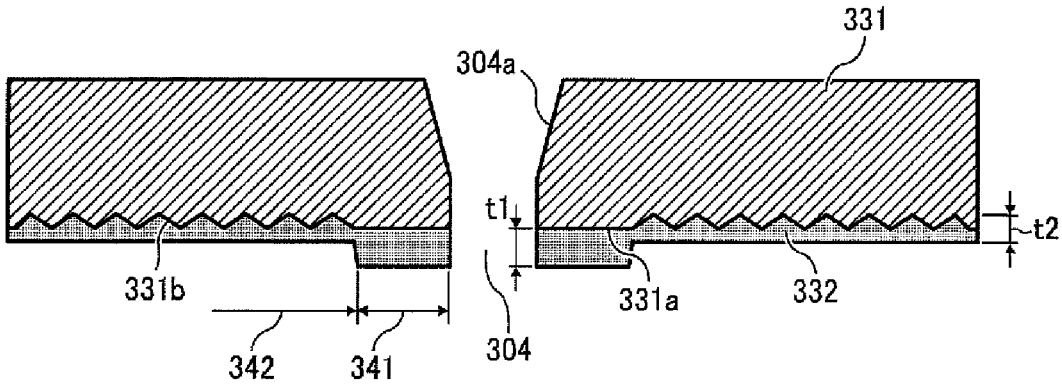
FIG. 15 is an enlarged section view illustrating a single nozzle portion of the nozzle plate.

Next, the nozzle plate 303 of the liquid ejection head 1000 is described in detail with reference to FIGS. 13 to 15. FIG. 13 is a plan view illustrating the nozzle plate 303. FIG. 14 is a section view illustrating the nozzle plate 303. FIG. 15 is an enlarged section view illustrating a single nozzle portion of the nozzle plate 303.

In the nozzle plate 303 illustrated in FIG. 15, a liquid-repellent film 332 is formed on a nozzle substrate 331 in which a nozzle orifice 304*a* partly forms a nozzle 304. A first surface area 331*a* of a nozzle proximal portion 341 of the nozzle orifice 304*a* on the nozzle substrate 331 is formed less irregular than a second surface area 331*b* of a nozzle distal portion 342 relatively farther from the nozzle orifice 304*a*. Further, a thickness t1 of the nozzle proximal portion 341 of the liquid-repellent film 332 is formed greater than a thickness t2 of the nozzle distal portion 342 of the liquid-repellent film 332. In particular, the nozzle proximal portion 341 is formed thicker up to an edge of the nozzle orifice 304*a* than the nozzle distal portion 342.

As described above, the nozzle proximal portion of the nozzle formation member adjacent to the nozzle 304 has a less-irregular surface and a thicker liquid-repellent layer than the nozzle distal portion farther from each nozzle orifice of the nozzle formation member. In particular, the nozzle proximal portion has a thicker liquid-repellent film up to an edge portion of the nozzle orifice than the nozzle distal portion. Such a configuration provides enhanced wiping resistance of the liquid-repellent layer at the nozzle proximal portion. Further, the surface irregularities at the nozzle distal portion prevent a repellent material from flowing out during application, allowing strong adhesion of the repellent material to the surface of the nozzle substrate. Meanwhile, the surface of the nozzle proximal portion is formed less irregular, providing a smooth edge of the nozzle orifice. Such a configuration prevents defective ejection of liquid droplets, allowing stable droplet ejection.

Next, a manufacturing process of the nozzle plate 303 of the liquid ejection head 1000 according to the fifth illustrative embodiment is described with reference to FIGS. 16(*a*) to 16(*d*) and 17(*a*) to 17(*c*).

Figure 16:
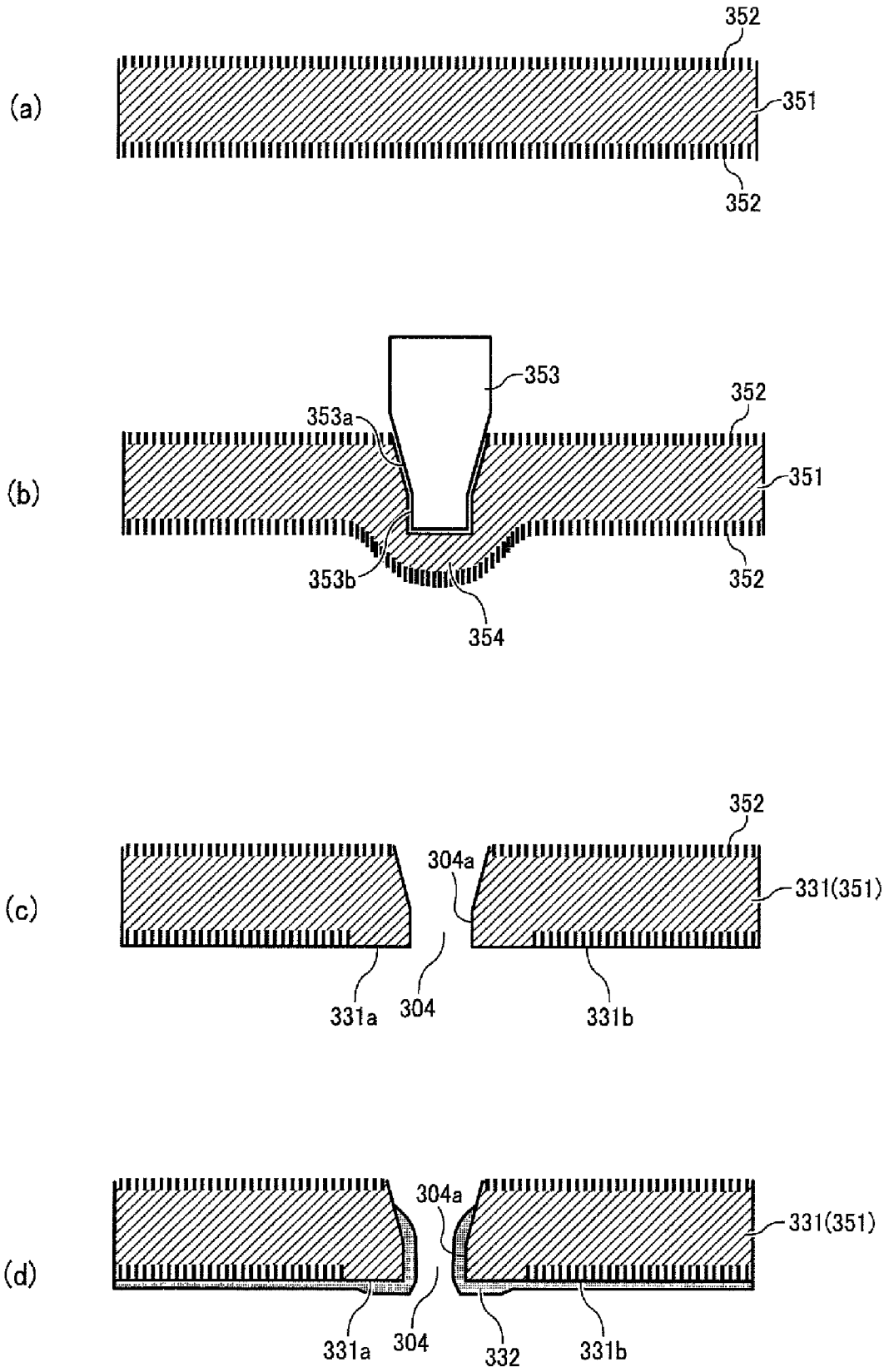
FIGS. 16(*a*) to 16(*d*) are section views illustrating a manufacturing process of the nozzle plate.

As illustrated in FIG. 16(*a*), for example, a rolled SUS board (nozzle substrate) 351 having a thickness of 60 μm is prepared. The SUS board 351 has surface irregularities 352 formed in the rolling process. In the following drawings, the surface irregularities 352 are indicated by hatching for the sake of simplicity.

As illustrated in FIG. 16(*b*), a portion of the SUS substrate 351 corresponding to the nozzle orifice 304*a* is pressed by a punch 353. At this time, the SUS substrate 351 is not fully punched out by the punch 353, thus forming a convex portion 354 at a face opposite a face pressed by the punch 353. Thus, the punch 353 forms a taper portion 353*a* and a linear portion 353*b*, and an internal wall of the pressed portion of the SUS substrate 351 is formed in a shape of the punch 353.

Then, as illustrated in FIG. 16(*c*), the convex portion 354 is removed by grinding, for example, tape grinding. By grinding the convex portion 354, a through hole is formed in the SUS substrate 351, providing a nozzle substrate 331 having a nozzle orifice 304*a* that is made from the SUS substrate 351. One side of the nozzle orifice 304*a* having a smaller orifice diameter is at the droplet ejection face. The surface of a nozzle proximal portion 331*a* adjacent the nozzle orifice 304*a* on the droplet ejection side of the nozzle substrate 331 is formed smooth by grinding. By contrast, the surface irregularities 352 formed during rolling of the SUS substrate 351 remain at the surface of the nozzle distal portion 331*b* farther from the nozzle orifice 304*a*.

Then, as illustrated in FIG. 16(*d*), the liquid-repellent film 332 is formed by applying a liquid-repellent material to the droplet ejection face. For example, a silicone liquid-repellent material may be employed as the liquid-repellent material. The liquid-repellent material, which is fluidized, may accumulate near the nozzle orifice 304*a*, thus forming a thicker portion of the liquid-repellent film near the nozzle orifice 304*a*, and a portion of such accumulated liquid may enter the nozzle orifice 304*a*. Hence, such a portion is dried and hardened by baking at, for example, 205° C. for one hour.

Figure 17:
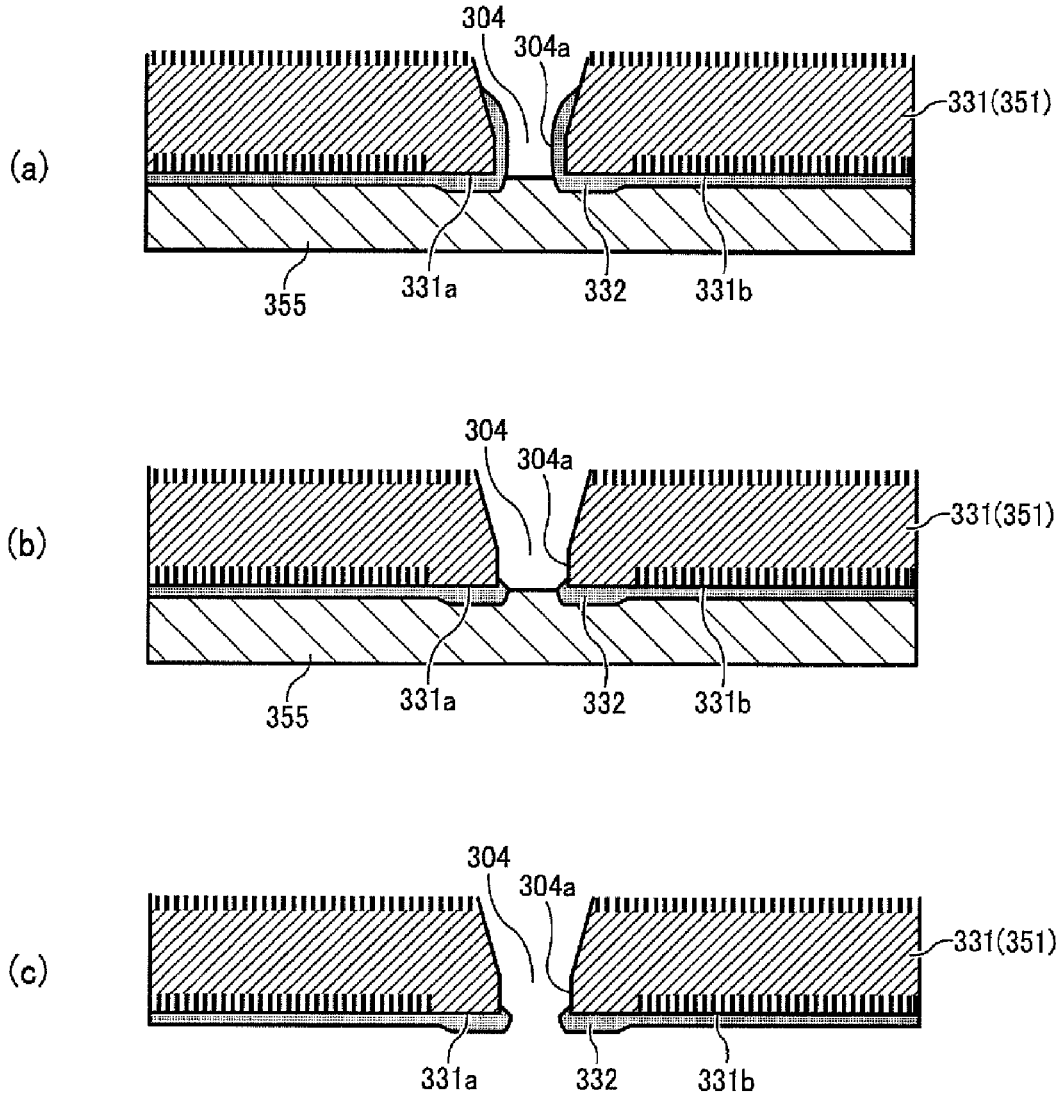
FIGS. 17(*a*) to 17(*c*) are section views illustrating a manufacturing process of the nozzle plate subsequent to the process illustrated in FIG. 16.

Then, as illustrated in FIG. 17(*a*), a protection member 355 is adhered to the side at which the liquid-repellent film 332 is formed. As the protection member 355, for example, a DFR (dry film resist) is adhered by laminating. Further, as illustrated in FIG. 17(*b*), oxygen plasma is irradiated to a side on which the protection member 355 is not adhered to remove the above-mentioned portion of the liquid-repellent film 332 having entered the nozzle orifice 304*a*. Then, as illustrated in FIG. 17(*c*), the protection member 355 is removed, and the manufacturing process of the nozzle plate 303 is finished.

In the nozzle plate 303 thus produced, the nozzle substrate 331 has surface irregularities at the nozzle distal portion 331*b* farther from the nozzle orifice 304*a*. Such a configuration prevents a liquid-repellent material from flowing out during application, allowing strong adhesion of the liquid-repellent material to the surface of the nozzle substrate 331. By contrast, the surface of the nozzle proximal portion 331*a* adjacent to the nozzle orifice 304*a* is formed less irregular and the edge of the nozzle orifice 304*a* is formed relatively smooth, thus preventing defective droplet ejection. Further, in the liquid-repellent film 332, the nozzle proximal portion 331*a* adjacent to the nozzle orifice 304*a* is formed thicker than the nozzle distal portion 331*b* farther from the nozzle orifice 304*a* in the liquid-repellent film 332. In particular, the thickness of the nozzle proximal portion 331*a* is greater to an edge of the nozzle orifice 304*a* than the thickness of the nozzle distal portion 331*b*. Such a configuration provides good wiping durability of the liquid-repellent film 332 at the nozzle proximal portion 331*a* adjacent to the nozzle orifice 304*a*.

Figure 18:
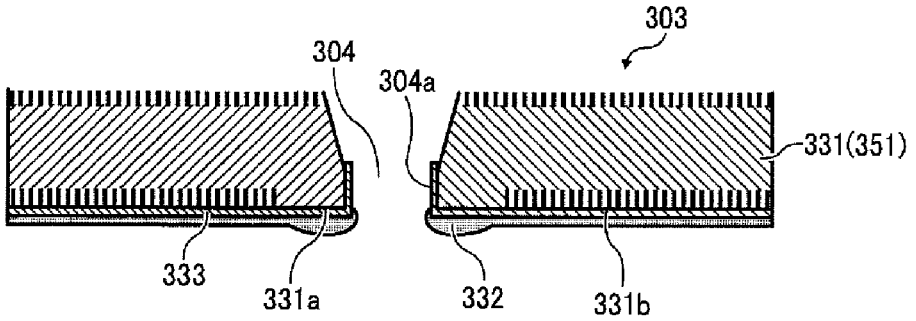
FIG. 18 is a section view illustrating a nozzle plate of a liquid ejection head according to an illustrative embodiment.

Next, a nozzle plate 303 of a liquid ejection head according to a sixth illustrative embodiment is described with reference to FIG. 18.

In the nozzle plate 303, for example, a $SiO_2$ film 333 serving as an inorganic oxide layer is provided between a nozzle substrate 331 and a liquid-repellent film 332. The $SiO_2$ film 333 is formed on the nozzle substrate 331, which is made from a SUS substrate, by sputtering.

At this time, the $SiO_2$ film 333 is firmly adhered to the nozzle substrate 331 (SUS substrate) and the liquid-repellent film 332 is firmly adhered to the $SiO_2$ film 333, providing further enhanced durability. Since the $SiO_2$ film 333 is a thin film of, for example, approximately 100 Å to 2,000 Å, the surface of the $SiO_2$ film 333 is shaped in accordance with the shape of the surface of the nozzle substrate 331. Thus, similar effects to those of the fifth illustrative embodiment can be obtained in the liquid-repellent film 332 formed on the $SiO_2$ film 333.

Next, a nozzle plate of a liquid ejection head according to a seventh illustrative embodiment is described with reference to FIGS. 19(*a*) to 19(*f*) and 20(*a*) to 20(*d*).

Figure 19:
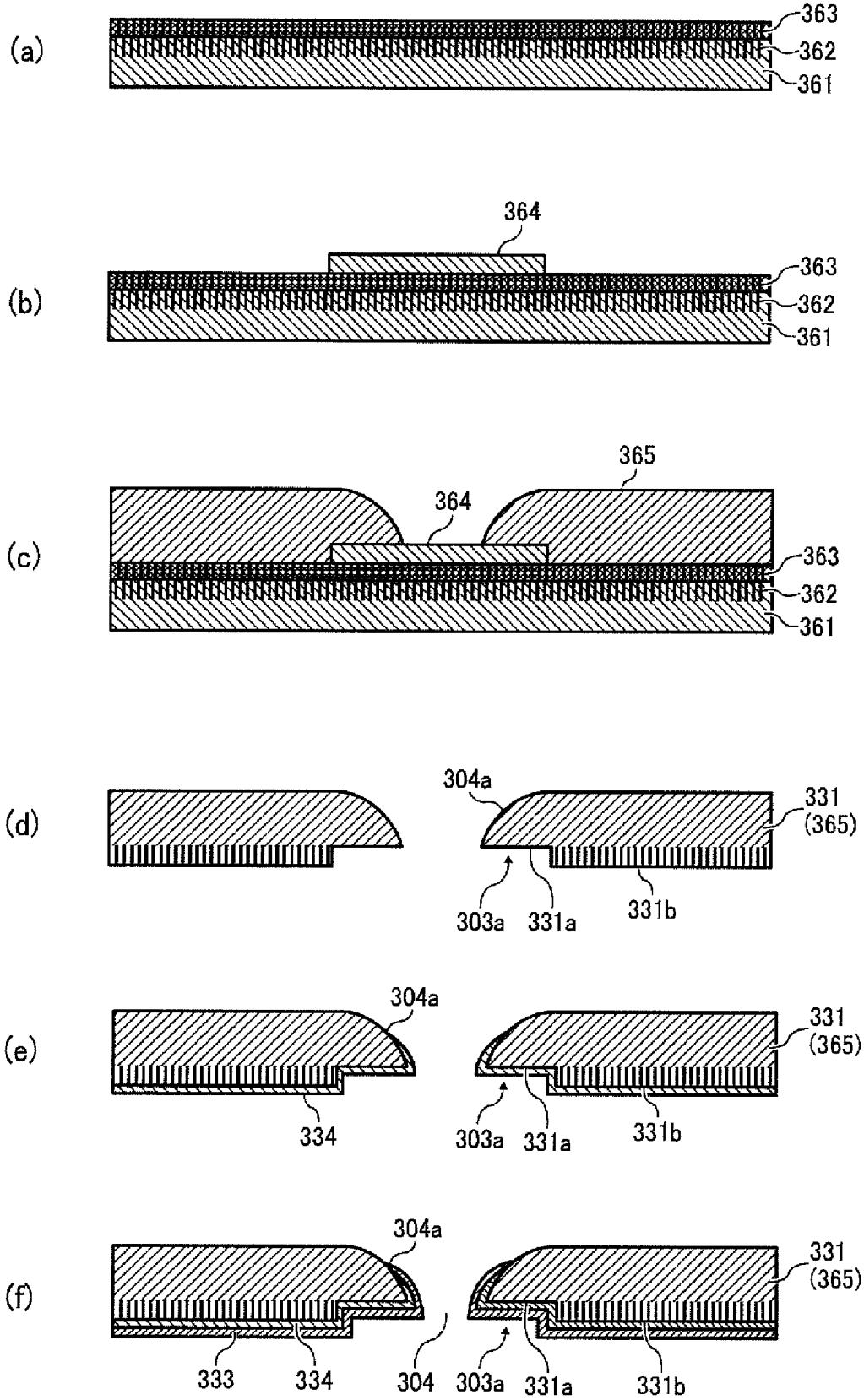
FIGS. 19(*a*) to 19(*f*) are section views illustrating a manufacturing process of a nozzle plate of a liquid ejection head according to an illustrative embodiment.

As illustrated in FIG. 19(*a*), a surface of a silicon substrate 361 is roughened by dry etching to form an irregular layer 362. On the irregular layer 362 is formed a Ti film 363 serving as a conductive layer. At this time, the surface shape (irregular shape) of the silicon substrate 361 also appears on the surface shape of the Ti film 363, and concaves and convexes are formed on the surface of the Ti film 363.

Then, as illustrated in FIG. 19(*b*), a resist pattern 364 having a thickness of approximately 1 μm corresponding to a concave portion 303*a* surrounding each nozzle 304 is formed by photolithography (exposure and development). At this time, as a resist forming the resist pattern 364 is fluidized, the minute surface irregularities of the Ti film 363 are not transferred to the surface of the resist pattern 364.

Then, as illustrated in FIG. 19(*c*), using the Ti film 363 as a conductive layer, a nickel film 365 is formed by growing nickel to a thickness of 30 μm by electroforming. At this time, the nickel film 365 shifts from a middle portion of the resist pattern 364 toward a middle portion of the nickel film 365 by an amount corresponding to a thickness of the nickel film 365. As a result, an opening portion of the nickel film 365 becomes a nozzle orifice. The dimensions of the resist pattern 364 are designed taking into account the final length of the nozzle diameter and the shift amount of nickel.

Then, as illustrated in FIG. 19(*d*), by separating the nickel film 365 from the silicon substrate 361, the nozzle substrate 331 made of the nickel film 365 is obtained. At this time, at a surrounding area of the nozzle orifice 304*a* of the nozzle substrate 331, a concave portion 303*a* in which the resist pattern 364 has been transferred is formed. For the nickel film 365 formed on the Ti film 362, the surface properties of the resist pattern 364 are transferred on the nickel film 365 at an interface between the nickel film 365 and the Ti film 362, thus providing surface irregularities to a nozzle distal portion 331*b* (indicated by hatching) farther from the nozzle orifice 304*a* of the nozzle substrate 331. By contrast, surface smoothness of the resist pattern 364 is transferred onto a portion of the nickel film 365 formed on the resist pattern 364, thus providing smoothness to a surface of a nozzle proximal portion 331*a* (a bottom face of the concave portion 303*a*) adjacent to the nozzle orifice 304*a* of the nozzle substrate 331.

Then, as illustrated in FIG. 19(*e*), a Ti film 334 serving as a foundation layer of the liquid-repellent film 332 is formed with a thickness of 10 nm by sputtering. At this time, the surface properties of the nozzle distal portion 331*b* of the nozzle substrate 331 made from the nickel film appear on the surface of the Ti film 334.

Further, as illustrated in FIG. 19(*f*), a $SiO_2$ layer 333 serving as a second foundation layer is formed with a thickness of 100 nm by sputtering. At this time, the surface properties of the Ti film 334 appear on the surface of the $SiO_2$ layer 333.

Figure 20:
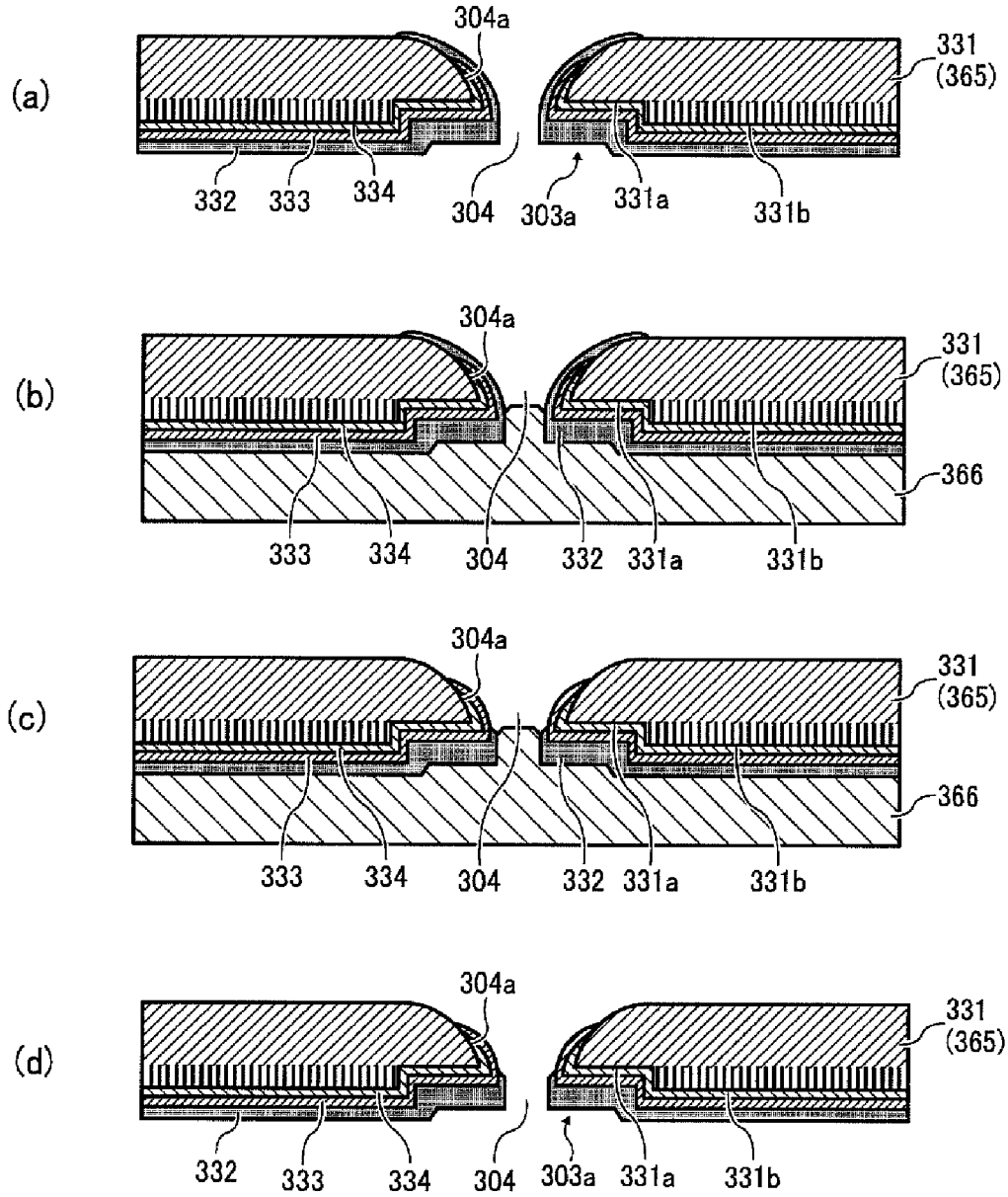
FIGS. 20(*a*) to 20(*d*) are section views illustrating a manufacturing process subsequent to the process illustrated in FIGS. 19(*a*) to 19(*f*)

Then, as illustrated in FIG. 20(*a*), the liquid-repellent film 332 is formed by vacuum deposition. Even if the vacuum deposition method is employed, a portion of the liquid-repellent film 332 may enter from an internal-wall face or an outer circumferential face to the back side (chamber side). For example, a fluorine liquid-repellent material may be employed as a liquid-repellent material of the liquid-repellent film 332. A preferred liquid repellency for such a fluorine liquid-repellent material is obtained by depositing, for example, a perfluoro polyether (a trade name "OPTOOL DSX" manufactured by Daikin Industries, ltd) with a thickness of approximately 5 to 20 nm.

When taking out of the deposition chamber after the deposition of the liquid-repellent material, the fluorine liquid-repellent agent and the $SiO_2$ film 333 are hydrolyzed with moisture in the air and chemically bound to form the fluorine liquid-repellent film 332. In the deposition of fluorine liquid-repellent material, such a fluorine liquid-repellent material is fluidized during deposition or just after deposition. Accordingly, a portion of the fluorine liquid-repellent material flows into the concave portion 303*a*, and the concave portion 303*a* (the nozzle proximal portion of the nozzle orifice 304*a*) of the liquid-repellent film 332 is formed thicker than any other area of the liquid-repellent film 332.

Then, as illustrated in FIG. 20(*b*), a protection member 336 is adhered to the liquid-repellent film 332. For example, as the protection member 366, a heat-resistant tape may be adhered by roller bonding.

Further, as illustrated in FIG. 20(*c*), $O_2$ plasma is irradiated to a face on which the protection member 366 is not adhered to remove the portion of the liquid-repellent film 332 having entered through the nozzle 304 to the back side.

Then, as illustrated in FIG. 20(*d*), the protection member 366 is peeled off to finish the nozzle plate 303.

Here, the fluorine liquid-repellent film is described. Conventionally, it has been considered sufficient that the fluorine liquid-repellent film is a mono-molecular layer having a thickness of approximately 2 to 3 nm. One reason is an assumption that, even if the fluorine liquid-repellent film is formed relatively thick, a first fluorine liquid-repellent film binding a substrate is a mono-molecular layer, and a second fluorine liquid-repellent film on the first fluorine liquid-repellent film is not bound to the substrate and has no effect on ink-repellent properties or wiping resistance.

However, through examinations, the inventors found that, when the fluorine liquid-repellent film is relatively thin, wiping resistance may fall. That is, when the liquid-repellent film on the surface of the nozzle plate is repeatedly wiped, the liquid repellency is gradually reduced, resulting in ejection failure of droplets. The inventors also found that, when the fluorine liquid-repellent film is relatively thick, the fluorine liquid-repellent film is sufficiently resistant against such repeated wiping.

Meanwhile, the thicker the liquid-repellent film, the time required for deposition process is lengthened and/or the consumption amount of deposition material is increased. Further, a relatively thick liquid-repellent film may result in ejection failure, such as so-called splash, during deposition. In such a case, the liquid-repellent material flies as relatively large droplets, adheres onto the surface of the nozzle substrate, and forms an uneven film. For these reasons, a minimum thickness of the liquid-repellent layer may be preferred.

In the deposition of the fluorine liquid-repellent film, when the fluorine material adheres to the surface of the nozzle substrate in the vacuum chamber, the fluorine liquid-repellent film behaves like liquid. Accordingly, the fluorine liquid-repellent film has a property of flowing into a fine pattern or a stepwise portion. Hence, in the present illustrative embodiment, the concave portion 303*a* is provided around the nozzle 304. Accordingly, as described above, the fluorine liquid-repellent material flows into the concave portion 303*a*, and the fluorine liquid-repellent film is formed thicker in the surrounding portion of the nozzle 304 than in other areas.

For example, one factor contributing to the droplet ejection performance is liquid repellency (ink repellency) of the nozzle surrounding area, which is a portion that receives a relatively-large wiping load. Therefore, the nozzle surrounding area may require excellent durability. Hence, according to the present illustrative embodiment, the fluorine liquid-repellent material is formed thicker in the nozzle surrounding area, allowing enhanced durability of the nozzle surrounding portion. In such a case, the depth of the concave portion 303*a* may be preferably set to, for example, approximately 0.5 to 3 μm. Further, the depth of the concave portion 303*a* is easily adjustable by changing the thickness of the resist pattern 364.

The concave portion 303*a* reduces damage caused by contact of a wiping member against to the surrounding portion of the nozzle 304. Further, even if a sheet directly contacts the nozzle formation face because of sheet jam or the like, the concave portion 303*a* prevents the sheet from directly contacting the surrounding portion of the nozzle 304.

As an application method of fluorine liquid-repellent material, for example, dipping, spin coating, roll coating, screen printing, or spray coating may be employed. Alternatively, a film formation method employing vacuum deposition may effectively provide enhanced durability of liquid-repellent film. Further, in the vacuum deposition, a series of film formation steps subsequent to the formation of the Ti film 334 and the $SiO_2$ film 333, which are illustrated in FIGS. 19(*e*) and 19(*f*), may be consecutively performed in the same vacuum chamber, providing further excellent effects. One conceivable reason is that, when a work is taken out of the vacuum chamber after the formation of the Ti film 334 or the $SiO_2$ film 333, impurities adheres onto the surface of the Ti film 334 or the $SiO_2$ film 333, resulting in a reduced adhesion.

Further, the present illustrative embodiment may be particularly effective when the liquid-repellent film is made of a liquid-repellent material behaving like liquid or fluid in the manufacturing process. As the liquid-repellent material, a silicone liquid-repellent material may be employed instead of the above-described fluorine liquid-repellent material. With the silicone liquid-repellent material, the state of a surface of the liquid-repellent film may be particularly important with respect to the liquid repellency because the surface greatly affects the liquid repellency. By contrast, in the fluorine liquid-repellent film, the state of an interface between the nozzle substrate and the fluorine liquid-repellent film may be important with respect to the liquid repellency. At this time, in the fluorine liquid-repellent film, only the mono-molecular layer adjacent to the interface binds the nozzle substrate. However, the inventors found that by thickening the liquid-repellent film, the number of molecules binding to the nozzle substrate increases and, as a result, enhanced durability can be obtained. The inventors also found that such enhanced durability obtained by thickening the liquid-repellent film is significantly greater in the fluorine liquid-repellent film, in which the interface between it and the nozzle substrate greatly contributes to the liquid repellency, than the silicone liquid-repellent film, in which the film surface greatly contributes to the liquid repellency. Therefore, the present illustrative embodiment may be particularly effective in forming a liquid-repellent film containing a fluorine liquid-repellent material.

Figure 21:
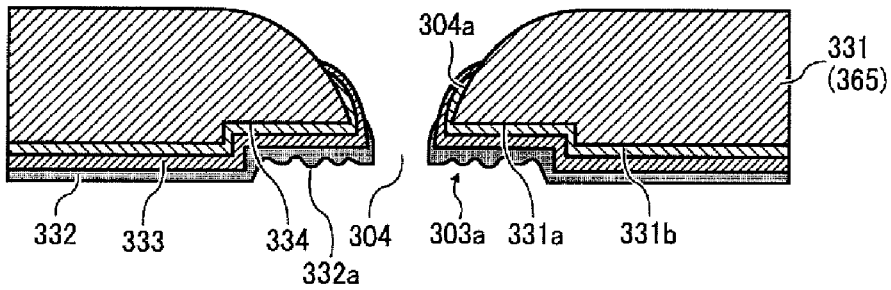
FIG. 21 is a section view illustrating a state of a liquid-repellent film of a concave portion at a nozzle proximal portion.

In this regard, when the fluorine liquid-repellent film is relatively thick, molecules in the liquid-repellent film aggregate in the concave portion 303*a*, which is thicker than other areas, and a convex portion 332*a* (multimeric layer 32*c*), as illustrated in FIG. 21, arises on the surface of the fluorine liquid-repellent film. The height of the convex portion 332*a* may be approximately 60 to 100 nm. Such a configuration provides enhanced wiping resistance without affecting ejection performance of the liquid ejection head.

In the present illustrative embodiment as well, in the nozzle plate 303, the surface irregularities of the nozzle distal portion 331*b* farther from the nozzle orifice 304*a* in the nozzle substrate 331 can prevent the liquid-repellent material from flowing out during application, allowing strong adhesion of the liquid-repellent material to the surface of the nozzle substrate 331. By contrast, the surface of the nozzle proximal portion 331*a* adjacent to the nozzle orifice 304*a* is formed less irregular and, as a result, the edge of the nozzle orifice 4 is formed smooth, preventing ejection failure, such as skewed ejection, of droplets. The liquid-repellent film 332 is formed thicker in the nozzle proximal portion 331*a* adjacent to the nozzle orifice 304*a* than in the nozzle distal portion 331*b* farther from the nozzle orifice 304*a*. Further, the nozzle proximal portion 331*a* of the liquid-repellent film 332 is formed thicker up to the edge of the nozzle orifice 304*a* than the nozzle distal portion 331*b* of the liquid-repellent film 332. Thus, excellent wiping resistance of the liquid-repellent film 332 can be obtained in the nozzle proximal portion 331*a* adjacent to the nozzle orifice 304*a*.

Figure 22:
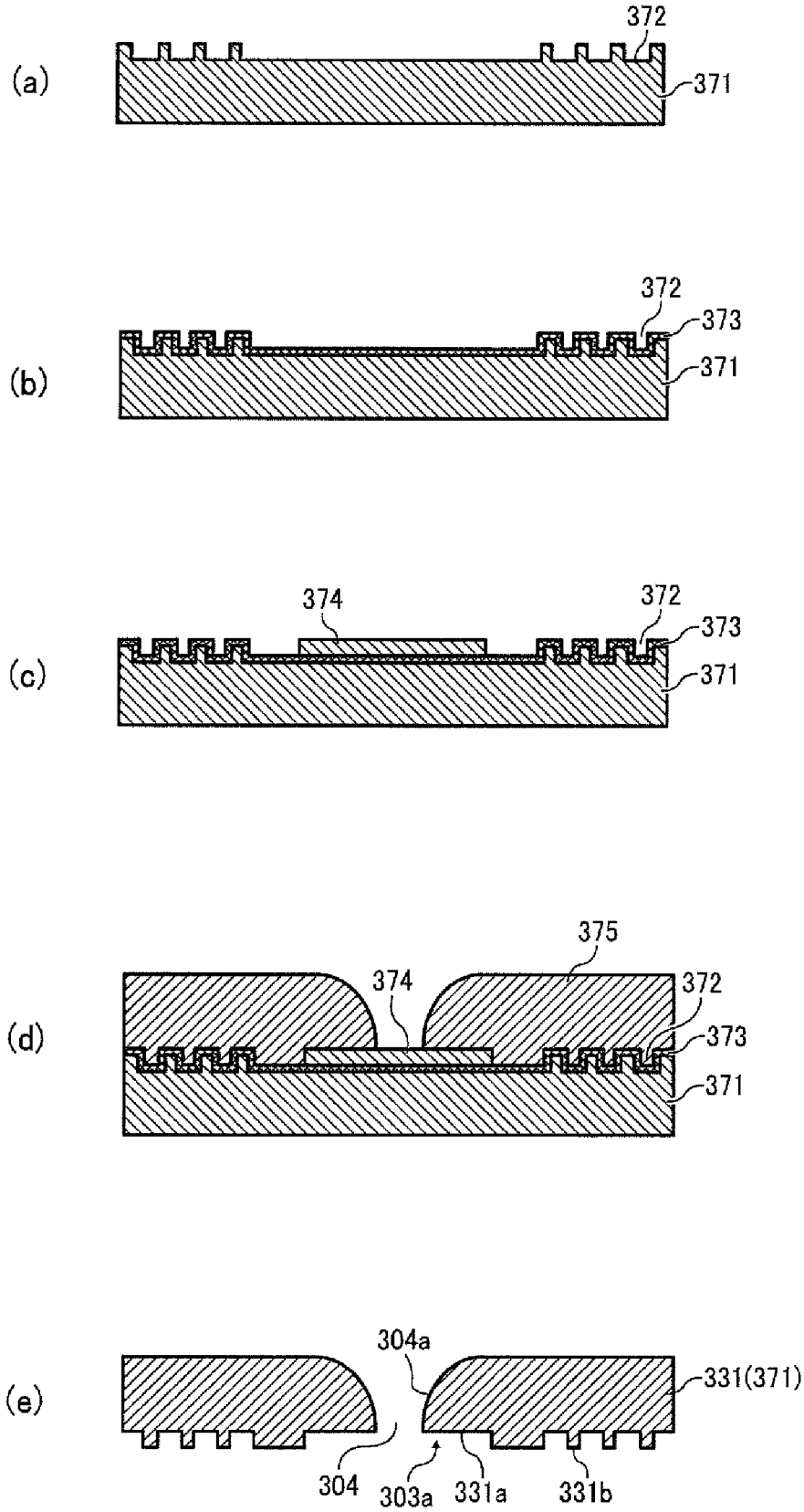
FIGS. 22(*a*) to 22(*e*) are section views illustrating a manufacturing process of a nozzle plate of a liquid ejection head used in an image forming apparatus according to an illustrative embodiment.

Next, a nozzle plate of a liquid ejection head according to an eighth illustrative embodiment and a manufacturing process of the nozzle plate are described with respect to FIGS. 22(*a*) to 22(*e*).

As illustrated in FIG. 22(*a*), a resist is applied onto a surface of a silicon substrate 371 and patterned by photolithography (exposure and development) to form a resist pattern. By dry-etching an opening portion of the resist pattern at a depth of approximately 200 nm, concave portions 372 are formed on the surface of the silicon substrate 371.

Then, as illustrated in FIG. 22(*b*), a Ti film 373 serving as a conductive layer is formed on the surface of the silicon substrate 371 on which the concave portions 372 are formed. At this time, the surface properties of the silicon substrate 371 also appear on the surface of the Ti film 373.

Further, as illustrated in FIG. 22(*c*), a resist pattern 374 having a thickness of 1 μm corresponding to a concave portion 303*a* surrounding a nozzle 304 is formed by photolithography (exposure and development).

Then, as illustrated in FIG. 22(*d*), using the Ti film 373 as the conductive layer, nickel is grown to a thickness of approximately 30 μm by electroforming to form a nickel film 375. At this time, a nickel film 375 shifts from a middle portion of the resist pattern 374 toward a middle portion of the nickel film 375 by an amount corresponding to a thickness of the nickel film 375. As a result, an opening portion of the nickel film 375 becomes a nozzle orifice 304*a*. The dimensions of the resist pattern 374 are designed taking into account the final length of the nozzle diameter and the shift amount of nickel.

By separating the nickel film 375 from the silicon substrate 371, the nozzle substrate 331 made of the nickel film 375 is obtained. At the surrounding area of the nozzle orifice 304*a* of the nozzle substrate 331 is formed a nozzle proximal portion 331*a* having a smooth surface on which the resist pattern 374 is transferred, while the concave portions 372 of the silicon substrate 371 are transferred onto the nickel film 375. Thus, irregularities are formed on the nozzle distal portion 331*b* farther from the nozzle orifice 304*a* of the nozzle substrate 331.

Then, in the same manner as the seventh illustrative embodiment, a liquid-repellent film 332 is formed.

As described above, in the present illustrative embodiment, the irregular surface of the nozzle substrate 331 is formed by photolithography and dry-etching. Accordingly, a desired pattern and depth can be selected to obtain optimum effect.

Figure 23:
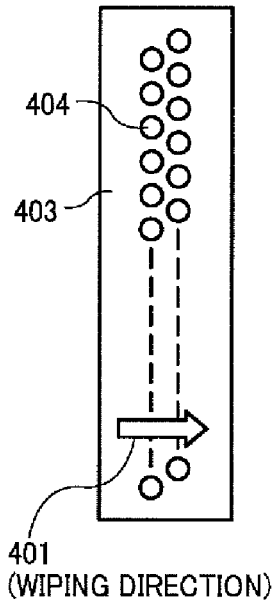
FIG. 23 is a plan view illustrating a configuration of the nozzle plate of the liquid ejection head used in the image forming apparatus.
Figure 24:
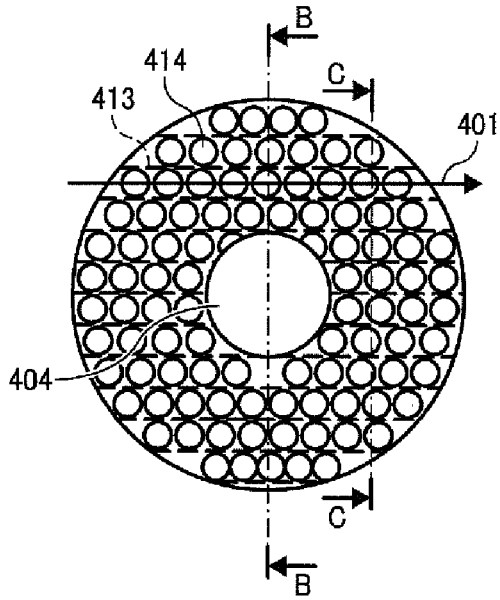
FIG. 24 is an enlarged view illustrating a nozzle-orifice portion of the nozzle plate.
Figure 25:
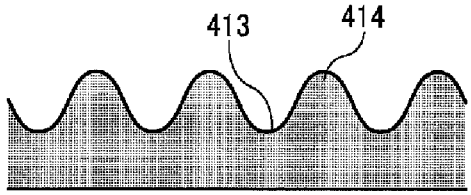
FIG. 25 is an enlarged view illustrating the nozzle-orifice portion cut along a line C-C illustrated in FIG. 24.

Next, a nozzle plate 403 of a liquid ejection head of an image forming apparatus according to an illustrative embodiment is described with reference to FIGS. 23 and 24. FIG. 23 is a plan view illustrating the nozzle plate 403. FIG. 24 is an enlarged view illustrating a nozzle-orifice portion of the nozzle plate 403 illustrated in FIG. 23. FIG. 25 is an enlarged section view illustrating the nozzle-orifice portion cut along a line C-C illustrated in FIG. 24.

The nozzle plate 403 is wiped by a wiping member of the image forming apparatus in a wiping direction indicated by an open arrow 401 illustrated in FIG. 23. As illustrated in FIG. 24, grooves 413 parallel to the wiping direction 401 are formed around each nozzle 404, and convex portions 414 are arrayed along the grooves 413.

As described above, the convex portions 414 are arrayed along the grooves 413 parallel to the wiping direction on the surface of the nozzle plate 403 (a liquid-repellent film 432). In such a configuration, as illustrated in FIG. 25, the convex portions 414 overlap each other with respect to the wiping direction and the grooves 413 are not blocked. Accordingly, when the nozzle plate 403 is wiped, ink adhered near the nozzle 404 can escape along the grooves 413, providing an increased ink-removal performance.

Such a configuration prevents wiped ink from accumulating at the edge portion of the nozzle 404, thus allowing stable meniscus formation and high-quality printing.

Figure 26:
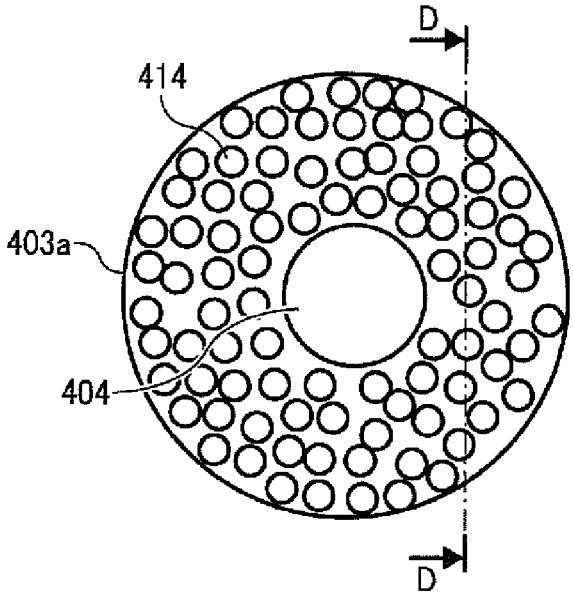
FIG. 26 is an enlarged view illustrating a nozzle-orifice portion of a nozzle plate in a comparative example.
Figure 27:
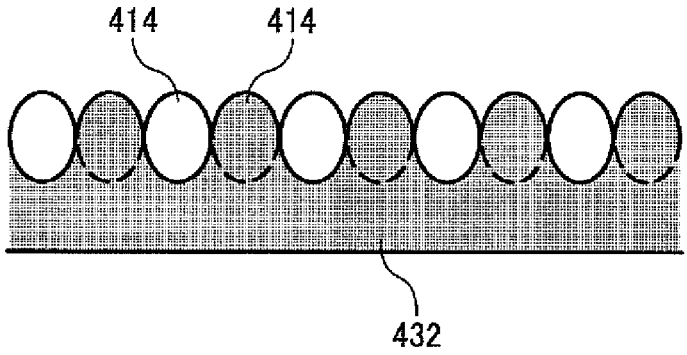
FIG. 27 is an enlarged view illustrating the nozzle-orifice portion cut along a line D-D illustrated in FIG. 26.

By contrast, if convex portions 414 are randomly formed as with a comparative example illustrated in FIG. 26, the convex portions 414 do not overlap each other with respect to the wiping direction, and the grooves 413 are not linearly formed.

Consequently, there is no escape way for wiped ink, resulting in a reduced ink-removal performance in wiping.

Figure 28:
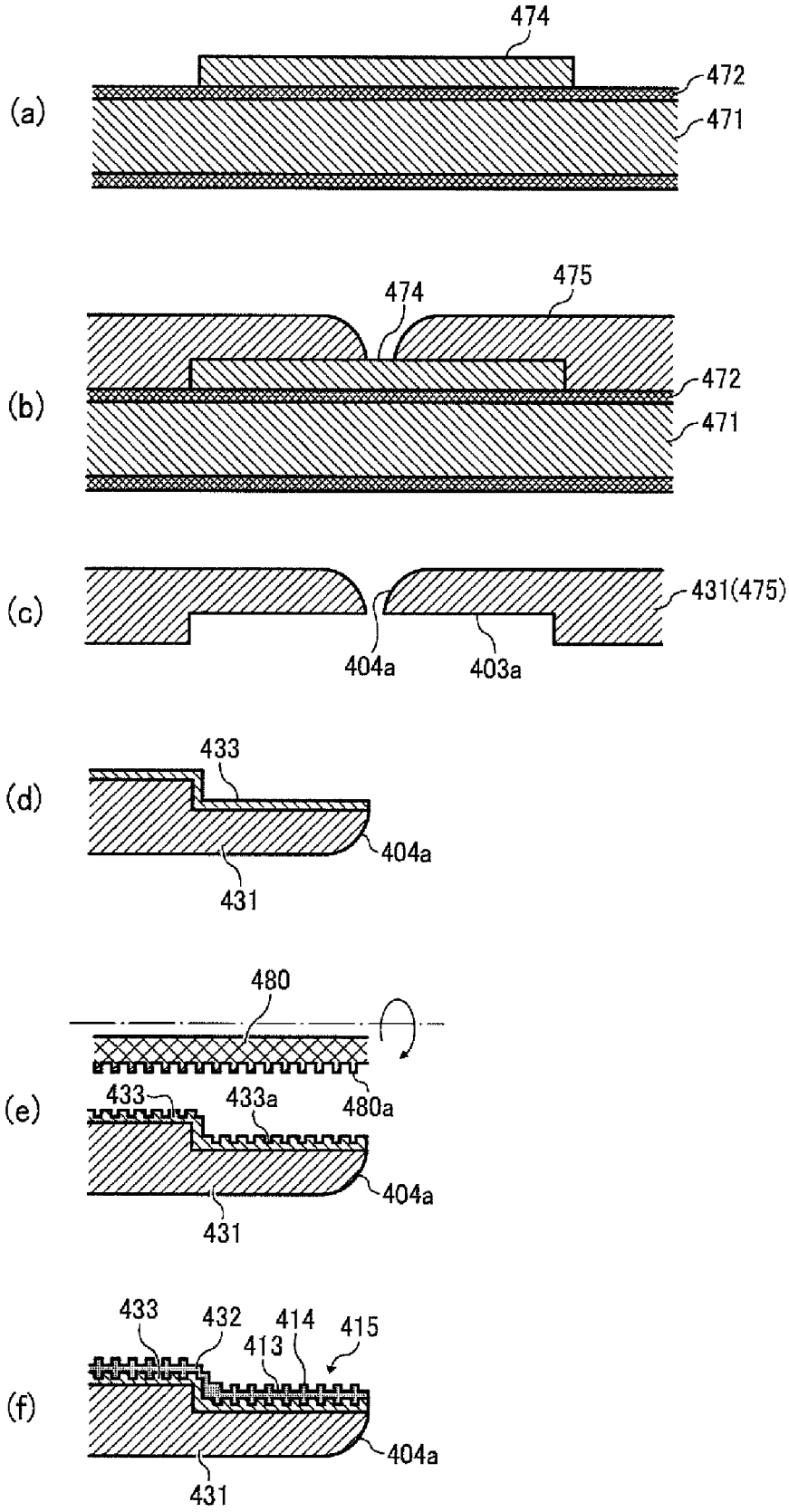
FIGS. 28(*a*) to 28(*f*) are section views illustrating a manufacturing process of a nozzle plate of a liquid ejection head according to an illustrative embodiment.

Next, a manufacturing process of the nozzle plate 403 is described with reference to FIGS. 28(*a*) to 28(*f*). FIGS. 28(*a*) to 28(*f*) are section views illustrating a nozzle-orifice portion cut along a line B-B illustrated in FIG. 24. Incidentally, FIGS. 28(*d*) to 28(*f*) illustrate half of the nozzle-orifice portion for simplicity.

First, as illustrated in FIG. 28(*a*), a Ti film 472 with a thickness of approximately 1,000 Å is formed on a silicon substrate 471 by a sputtering device, and a nozzle-orifice formation pattern 474 is formed on the Ti film 472 by application, exposure, and development of a photoresist.

As illustrated in FIG. 28(*b*), nickel is grown on the Ti film 472 by electroforming to form a nickel film 475.

Then, as illustrated in FIG. 28(*c*), by separating the nickel film 475 from the silicon substrate 471, the nozzle substrate 431 made of the nickel film 475 is obtained, and the photoresist remaining on the surface on which a liquid-repellent film is formed is removed by oxygen plasma.

Further, as illustrated in FIG. 28(*d*), a $SiO_2$ film 433 with a thickness of approximately 1,000 Å is formed on a surface of the nozzle substrate 431 by the sputtering device. At this time, to enhance the adhesion of the $SiO_2$ film 433 against the nickel film 475 serving as the nozzle substrate 431, as described above, a Ti film with a thickness of, for example, 100 Å may be formed on the nozzle substrate 431 by the sputtering device, and then the $SiO_2$ film 433 may be formed on the Ti film.

Then, as illustrated in FIG. 28(*e*), a rotation body 480 having fine irregularities 480*a* on the surface is rotated in a direction identical to the wiping direction so as to contact the surface of the nozzle substrate 431. Thus, an irregular pattern 433*a* including concave and convex portions parallel to the wiping direction are formed on the surface of the $SiO_2$ film 433 on the nozzle substrate 431. It is to be noted that the method of forming the irregular pattern 433*a* is not limited to the above-described manner. For example, the irregular pattern 433*a* may be formed by rubbing a plate member having an irregular surface against the $SiO_2$ film 433 on the surface of the nozzle substrate 431 in the wiping direction.

In such a case, for example, when the Ti film is formed between the nozzle substrate 431 and the $SiO_2$ film 433 as described above, such an irregular pattern may be formed on the Ti film. In this case, the $SiO_2$ film 433 formed on the Ti film is formed while enhancing the Ti film serving as a foundation layer. Accordingly, when the formation of the $SiO_2$ film 433 is finished, grooves are also formed on the $SiO_2$ film 433, thus obviating an additional step of forming grooves on the $SiO_2$ film 433. Alternatively, grooves may be formed on the nickel film itself serving as the nozzle substrate 431, thus obviating steps of forming grooves on the Ti film and the $SiO_2$ film 433.

As described above, by forming grooves parallel to the wiping direction on the foundation layer, the array direction of the convex portions is determined by the direction of grooves of the foundation layer. Such a configuration allows an increased degree of freedom in nozzle design and a reduced production cost.

Then, as illustrated in FIG. 28(*f*), a liquid-repellent film 432 is formed on the $SiO_2$ film 433 of the nozzle substrate 431 by a vacuum deposition device. As described above, a silicone or fluorine material may be used as the liquid-repellent material. Below, a description is given of an example in which the above-described fluorine liquid-repellent material having the trade name "OPTOOL DSX" is employed.

At this time, since the concave portion 403*a* is formed around the nozzle 404 of the nozzle substrate 431, the fluorine liquid-repellent material may flow into the concave portion 403*a*. As a result, a nozzle proximal portion 431*a* adjacent to the nozzle 404 in the liquid-repellent film 432 is formed thicker than a nozzle distal portion 431*b* farther from the nozzle 404 in the liquid-repellent film 432, and such flow of the fluorine liquid-repellent material forms an irregular pattern 415 (a pattern of grooves 413 and convex portions 414). Thus, on the surface of the liquid-repellent film 432, the grooves 413 parallel to the wiping direction are formed by the grooves 435 formed on the foundation layer (the $SiO_2$ film 433), generating the irregular pattern 415 in which the convex portions 414 are formed in line.

Thus, by arraying the convex portions 414 along the grooves 413 formed parallel to the wiping direction on the surface of the nozzle plate 403 (the surface of the liquid-repellent film 432), as illustrated in FIG. 25, the convex portions 414 overlap each other with respect to the wiping direction and the grooves 413 are not blocked. Such a configuration, ink adhered near the nozzle 404 can escape along the grooves 413, providing enhanced ink-removal performance. In this illustrative embodiment, the convex portions 414 are formed on the multimeric layer 32*c*, providing an enhanced wiping resistance of the nozzle proximal portion.

Figure 29:
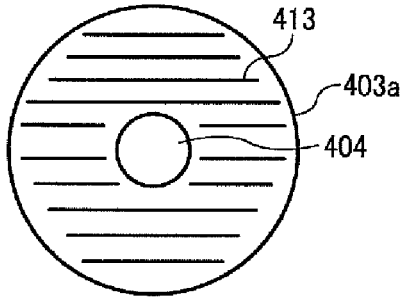
FIG. 29 is a schematic plan view illustrating a nozzle plate of a liquid ejection head according to an illustrative embodiment.

Next, a nozzle plate 403 of a liquid ejection head according to a ninth illustrative embodiment is described with reference to FIG. 29.

In this illustrative embodiment, grooves 413 formed on the surface of the nozzle plate 403 do not contact a nozzle 404. Accordingly, since the grooves 413 are not formed at the edge of the nozzle 404, the nozzle shape is maintained uniform, allowing stable meniscus formation and high-quality printing.

Here, a manufacturing process of the nozzle plate 403 is described with reference to FIGS. 30(*a*) to 30(*g*).

Figure 30:
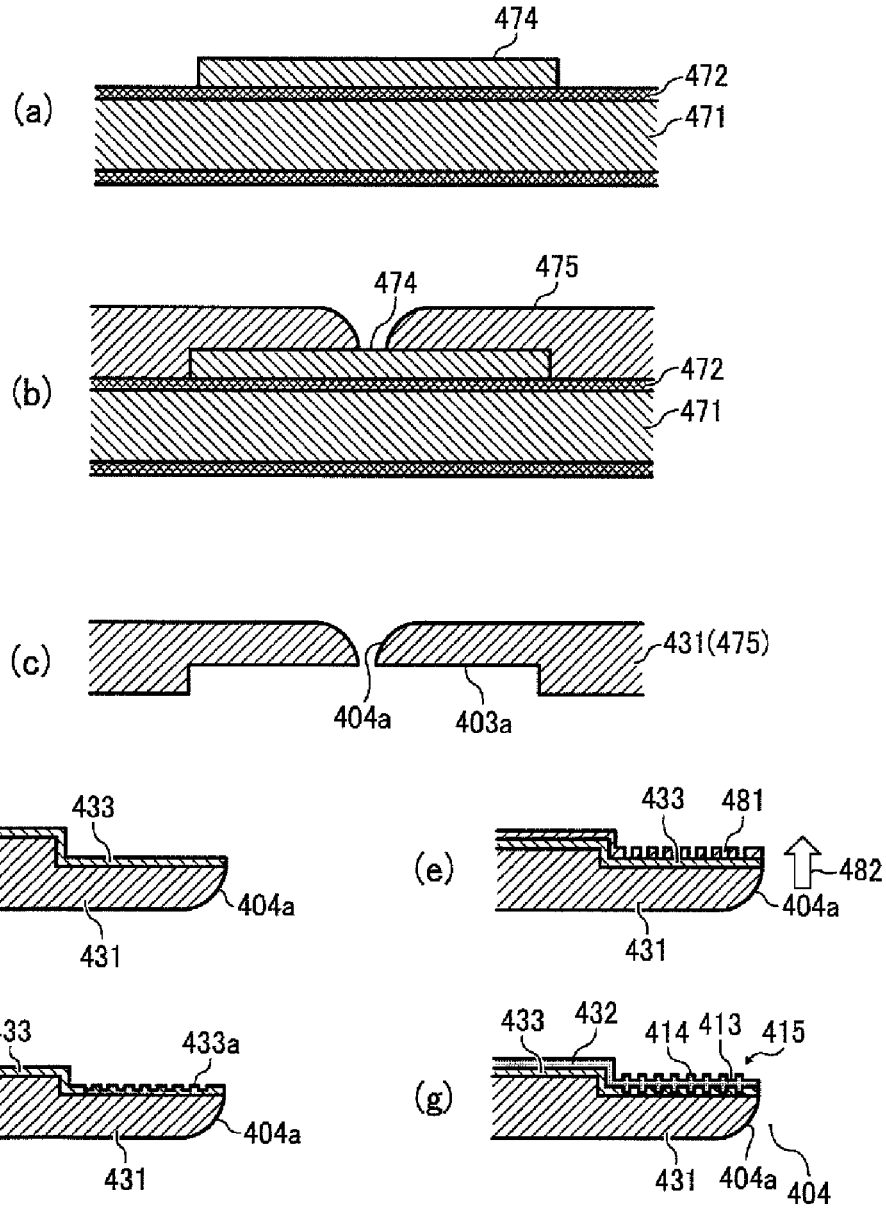
FIGS. 30(*a*) to 30(*g*) are section views illustrating a manufacturing process of the nozzle plate.

First, manufacturing steps illustrated in FIGS. 30(*a*) to 30(*d*) are performed in a manner similar to those illustrated in FIGS. 28(*a*) to 28(*d*). Here, descriptions of FIGS. 30(*a*) to 30(*d*) are omitted for the sake of simplicity.

Then, as illustrated in FIG. 30(*e*), a resist pattern 481 is formed by photolithography (exposure and development) at an adjacent area of a nozzle 404 on a $SiO_2$ film 433. The resist pattern 481 is formed parallel to a wiping direction of a wiping member at an area except an edge portion of the nozzle 404. At this time, a resist is sprayed to the $SiO_2$ film 433 while promoting airflow by $N_2$ blow from a chamber side of the nozzle 404, preventing the resist from entering into the chamber side.

Further, as illustrated in FIG. 30(*f*), using the resist pattern 481 as a mask, groove portions 433*a* are formed on the $SiO_2$ film 433 by dry etching. Such dry etching can be easily performed by an RIE (Reactive Ion Etching) device with, for example, RF (radio frequency) power of approximately 300 to 500 W, CF4 gas of 100 to 200 cc, and pressure of approximately 200 to 400 Pa. Then, the resist 481 is removed by oxygen plasma. Thus, the grooves 413, which are parallel to the wiping direction and do not contact the nozzle 404, are formed on the $SiO_2$ film 433.

Further, as illustrated in FIG. 30(*g*), a liquid-repellent film 432 is formed on the surface of the $SiO_2$ film 433. For example, the liquid-repellent film 432 may be formed with the above-described fluorine liquid-repellent film, OPTOOL DSX.

Next, a manufacturing method of a liquid ejection head according to an illustrative embodiment is described.

Figure 31:
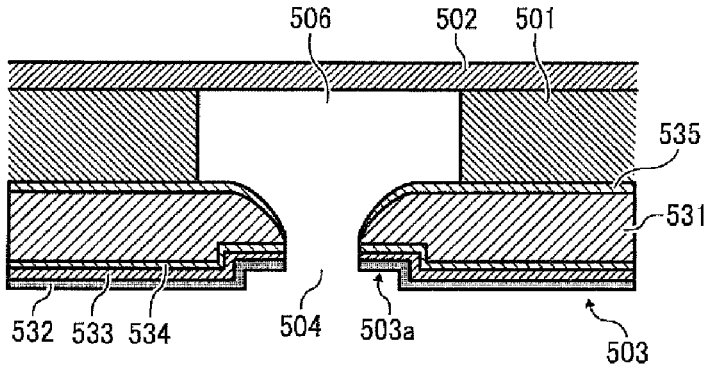
FIG. 31 is an enlarged section view illustrating a liquid ejection head manufactured by a liquid-ejection-head manufacturing method according to an illustrative embodiment.

First, an example of the liquid ejection head manufactured by the manufacturing method is described with reference to FIG. 31. As with the above-described liquid ejection head, the liquid ejection head according to the present illustrative embodiment includes a nozzle plate 503 in which a nozzle 504 is formed, a channel member 501 in which a chamber 506 communicated with the nozzle 504 is formed, and a diaphragm member 502 forming a wall face of the chamber 506. In the nozzle plate 503, a liquid-repellent film 532 is formed via a Ti layer 534 and a first $SiO_2$ layer 533, serving as intermediate layers, on a droplet ejection face of a nozzle substrate 531, such as a nickel plate, in which a nozzle orifice 504*a* is formed. On the opposite face (chamber-side face), a second $SiO_2$ layer 535 is formed to provide enhanced binding to the channel member 501. A concave portion 503*a* is formed around the nozzle 504.

The nozzle substrate 531 of the nozzle plate 503 is formed by precipitating a nickel film by Ni electroforming in a manner similar to the above-described manufacturing process, and therefore a description thereof is omitted for the sake of simplicity.

Here, a film-formation process of the liquid-repellent film on the nozzle substrate 531 is described with reference to FIGS. 32(*a*) to 32(*e*).

Figure 32:
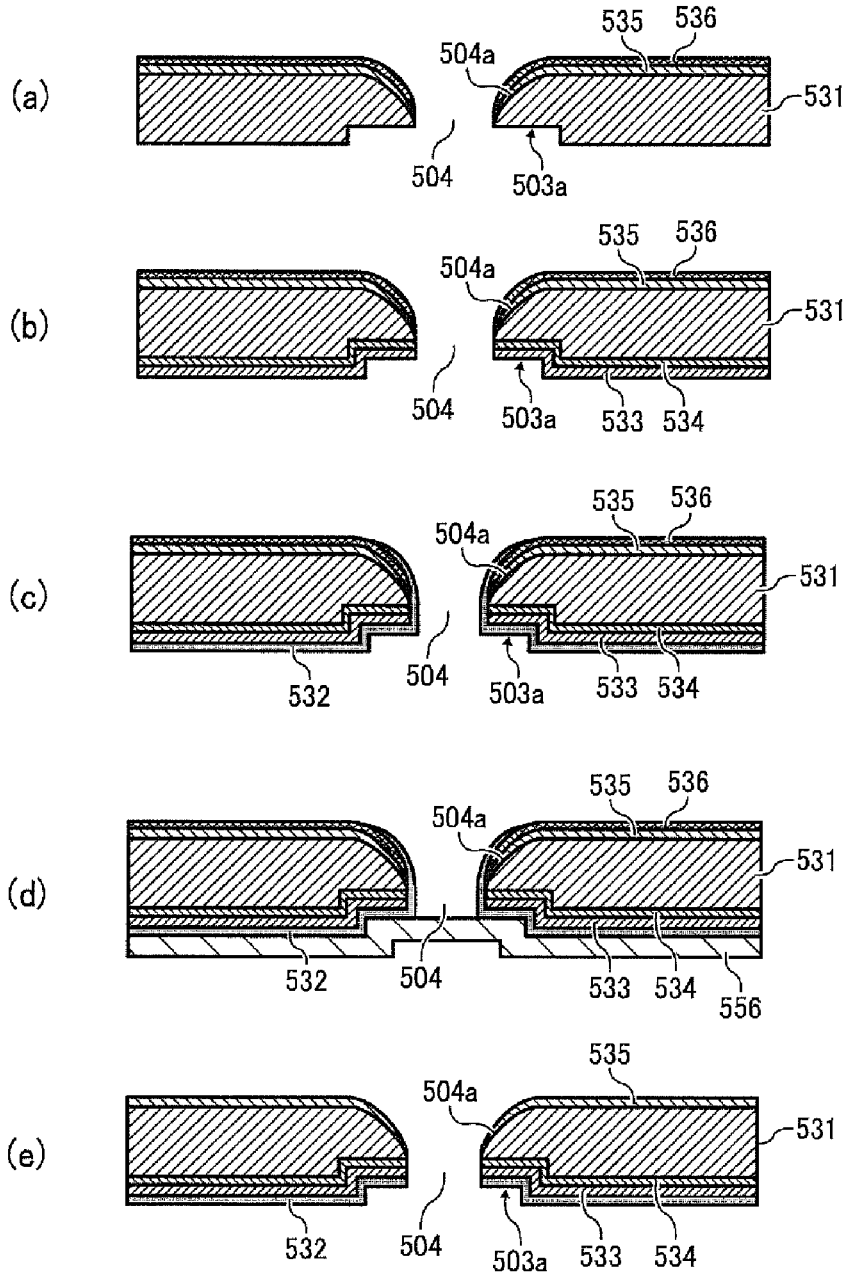
FIGS. 32(*a*) to 32(*e*) are section views illustrating a manufacturing method illustrating a nozzle plate of the liquid ejection head.

First, as illustrated in FIG. 32(*a*), plasma cleaning is performed on the chamber-side face of the nozzle substrate 531, and the second $SiO_2$ layer 535 is formed with a thickness of 100 nm as an adhesion layer adhering the chamber member 501. The second $SiO_2$ layer 535 also serves as a mask for etching used in removing a sacrificial layer.

Then, as illustrated in FIG. 32(*b*), the Ti layer 534 with a thickness of, for example, 10 nm and the first $SiO_2$ layer 533 with a thickness of, for example, 100 nm are laminated as intermediate layers on the droplet ejection face of the nozzle substrate 531.

Then, as illustrated in FIG. 32(*d*), a plasma mask 556 is formed using dicing tape on the droplet ejection face. Hydrophilic processing is performed by plasma processing, and a portion of the liquid-repellent film 532 having entered into an interior of the nozzle orifice 504*a* is removed along with a sacrificial layer (e.g., an aluminum layer) 536. Thus, the nozzle plate 503 having the droplet ejection face on which the liquid-repellent film 532 is formed is obtained.

As described above, the manufacturing method includes forming a sacrificial layer made of metal or inorganic material on a chamber formation face of a nozzle substrate, forming a liquid-repellent film on a droplet ejection face, and removing the portion of the liquid-repellent film adhered to the interior of the nozzle orifice along with the sacrificial layer. By using a thin film made of metal or inorganic material as the sacrificial layer, the liquid-repellent film formed on the sacrificial layer is sufficiently thin as compared with the liquid-repellent film formed on the droplet ejection face, providing enhanced production accuracy of the nozzle-orifice edge portion after removal of the sacrificial layer.

The manufacturing method may further include providing a plasma mask on the droplet ejection face, performing hydrophilic processing by irradiating plasma from the chamber formation face to the portion of the liquid-repellent film having adhered to the interior wall of the nozzle, and removing the adhered portion of the liquid-repellent film along with a sacrificial layer by wet etching. Such a configuration allows easily removing the sacrificial layer.

Alternatively, the manufacturing method may include forming an etching mask layer on the chamber formation face and forming a sacrificial layer on the etching mask layer. Such a configuration provides enhanced selective etching performance with respect to the sacrificial layer on the chamber formation face and allows the etching mask layer to serve as an adhesion layer between the nozzle plate and the channel member, providing good bonding strength.

Figure 33:
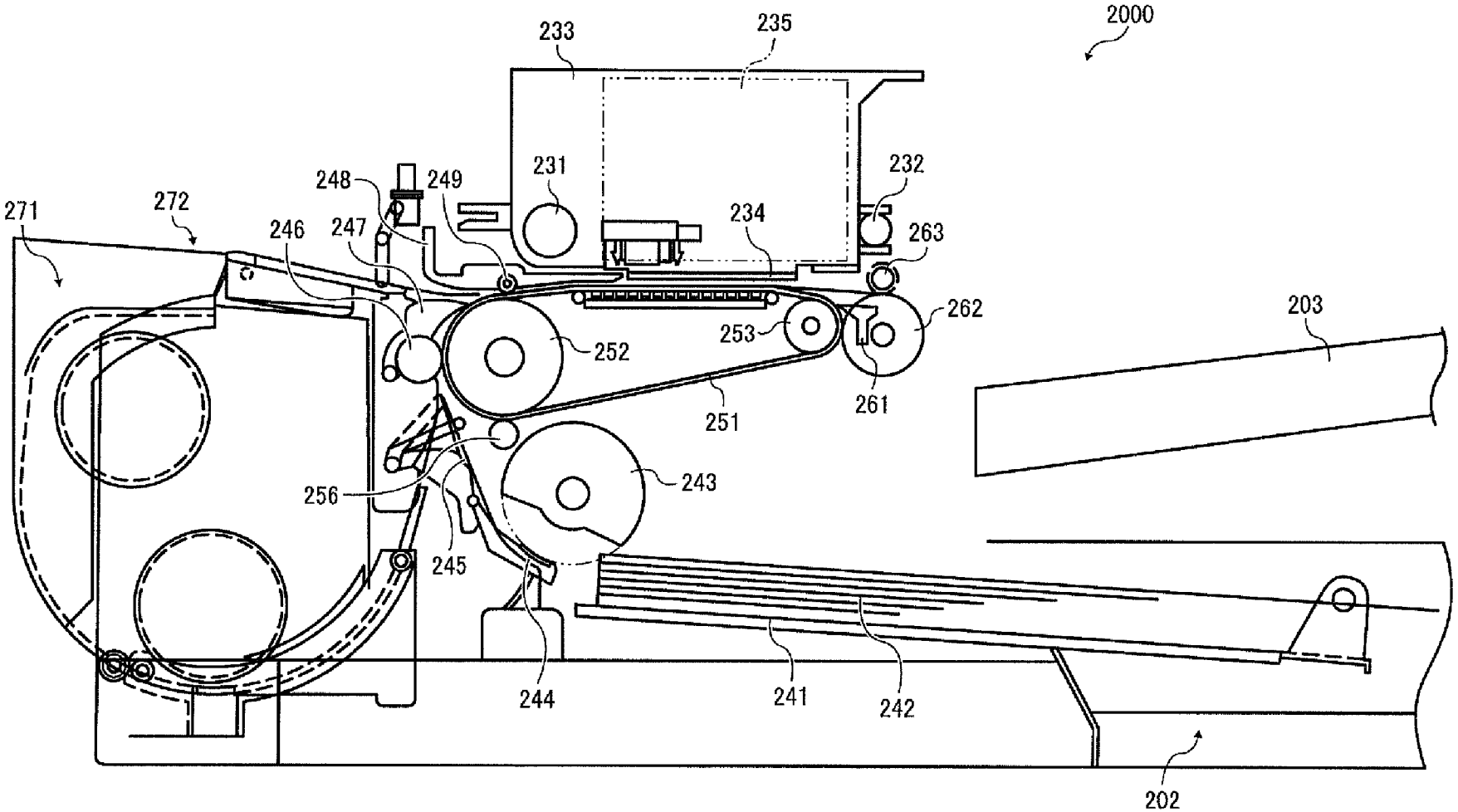
FIG. 33 is a schematic view illustrating a configuration of an image forming apparatus according to an illustrative embodiment.
Figure 34:
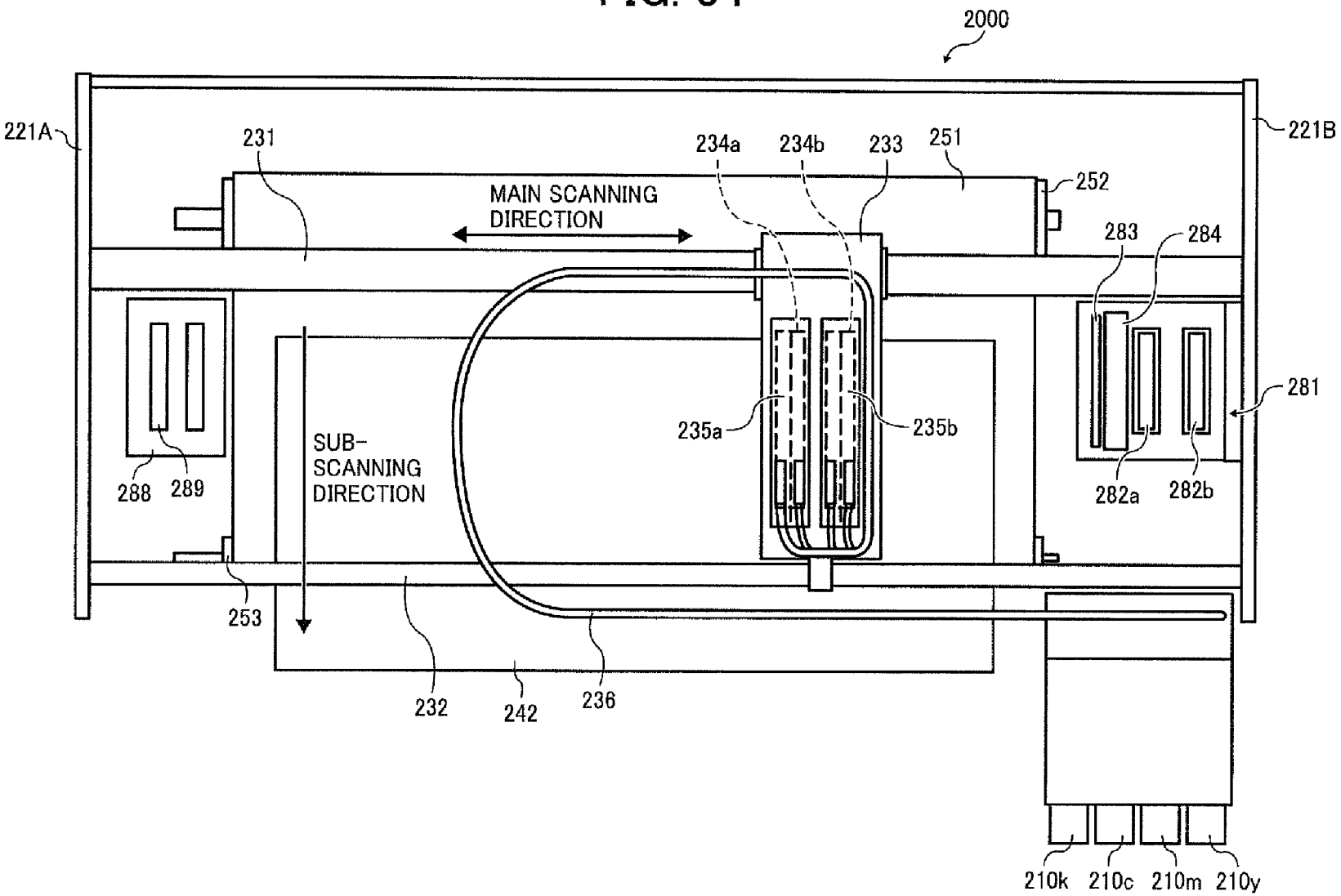
FIG. 34 is a plan view illustrating a portion of the image forming apparatus illustrated in FIG. 33.

Next, one example of an image forming apparatus 2000 employing a liquid ejection head according to an illustrative embodiment is described with reference to FIGS. 33 and 34. FIG. 33 is a schematic view illustrating a configuration of a mechanical section of the image forming apparatus 2000. FIG. 34 is a plan view illustrating the mechanical section illustrated in FIG. 33.

In FIGS. 33 and 34, the image forming apparatus 2000 is a serial-type image forming apparatus and slidably holds a carriage 233 by a main guide rod 231 and a sub guide rod 232. The main guide rod 231 and the sub guide rod 232 serving as guide members are extended between left and right side-plates 221A and 221B. The carriage 233 is moved for scanning in a main scanning direction by a main-scan motor via a timing belt.

On the carriage 233 are mounted recording heads 234*a* and 234*b* (referred to as "recording heads 234" unless distinguished), serving as a liquid ejection head, to eject ink droplets of yellow (Y), cyan (C), magenta (M), and black (K). The recording heads 234 are mounted on the carriage 233 so that nozzle rows consisting of a plurality of nozzles are arrayed in a sub-scanning direction perpendicular to the main scan direction and ink droplets are ejected downward.

Each of the recording heads 234 may have two nozzle rows. For example, black (K) droplets are ejected from a first nozzle row of the recording head 234*a* and cyan (C) droplets are ejected from a second nozzle row of the recording head 234*a*. Further, magenta (M) droplets are ejected from a first nozzle row of the recording head 234*b* and yellow (Y) droplets are ejected from a second nozzle row of the recording head 234*b*.

It is to be noted that the liquid ejection head according to the present illustrative embodiment, which constitutes the recording heads 234, is not limited to the above-described piezoelectric-type liquid ejection head employing piezoelectric elements. The liquid ejection head may be, for example, a so-called thermal-type liquid ejection head that generates bubbles by heating ink in an ink channel using a heating resistant member or an electrostatic-type liquid ejection head that changes ink-channel capacity by deforming a diaphragm using electrostatic force generated between the diaphragm and electrodes to eject ink droplets.

On the carriage 233 are also mounted head tanks 235*a* and 235*b* (referred to as "head tanks 235" unless distinguished) to supply color inks associated with the respective nozzle rows of the recording heads 234. The color inks are refilled from ink cartridges 210*k*, 210*c*, 210*m*, and 210*y* to the associated head tanks 235 through supply tubes 36.

The image forming apparatus 2000 also includes a sheet feed section that feeds sheets 242 stacked on a sheet stack portion (platen) 241 of a sheet feed tray 202. The sheet feed section includes a sheet feed roller 243 that separates and feeds sheets 242 sheet by sheet from the sheet stack portion 241 and a separation pad 244 that is disposed opposite and biased against the sheet feed roller 243.

To feed the sheet 242 from the sheet feed section to an area below the recording heads 234, the image forming apparatus 2000 further includes a guide member 245 that guides the sheet 242, a counter roller 246, a conveyance guide member 247, a regulation member 248 having a front-end press roller 249, and a conveyance belt 251 that conveys the sheet 242 to a position facing the recording heads 234 while electrostatically attracting the sheet 242 thereon.

The conveyance belt 251 is an endless belt extended around a conveyance roller 252 and a tension roller 253 so as to circulate in a sub-scanning direction (belt conveyance direction). The image forming apparatus 2000 also includes a charging roller 256 that charges a surface of the conveyance belt 251. The charging roller 256 contacts the surface of the conveyance belt 251 so as to rotate in conjunction with the rotation of the conveyance belt 251. By rotating the conveyance roller 252 via a timing belt by a sub-scanning motor, not illustrated, the conveyance belt 251 is circulated in the belt conveyance direction.

Further, the image forming apparatus 2000 includes a sheet output section that outputs the sheet 242 on which an image has been recorded by the recording heads 234. The sheet output section includes a separation claw 261 that separates the sheet 242 from the conveyance belt 251, a first sheet-output roller 262, a second sheet-output roller 263, and a sheet-output tray 203 below the first sheet-output roller 262.

A duplex unit 271 is detachably mounted on a rear side of the image forming apparatus 2000. The duplex unit 271 receives the sheet 242 returned by reverse rotation of the conveyance belt 251, turns the sheet 242 upside down, and feeds the sheet 242 between the counter roller 246 and the conveyance belt 251. A top face of the duplex unit 271 is configured as a manual feed tray 272.

In a non-print area at one side of the scanning direction of the carriage 233 is provided a maintenance-and-recovery mechanism 281 that maintains and recovers a preferred nozzle condition of the recording heads 234. The maintenance-and-recovery mechanism 281 includes, for example, cap members (hereinafter, simply referred to as "caps") 282*a* and 282*b* to cap the nozzle formation faces of the recording heads 234, a wiper blade 282 serving as the wiping member to wipe the nozzle formation faces, and a spittoon 284 for receiving droplets ejected for maintenance rather than for image formation.

Meanwhile, in another non-print area at the other side of the scanning direction of the carriage 233 is provided a second spittoon 288 serving as a liquid container that receives droplets ejected for maintenance rather than for image formation. The second spittoon 288 has, for example, opening portions 289 provided along the nozzle array direction of the respective recording head 234.

In the image forming apparatus 2000 having such a configuration, the sheets 242 are separated and fed sheet by sheet from the sheet feed tray 202, guided toward a substantially vertical direction by a guide 245, and conveyed sandwiched between the conveyance belt 251 and the counter roller 246. Further, a front end of the sheet 242 is guided by a conveyance guide 237 and pressed against the conveyance belt 251 by the front-end press roller 249. Thus, the conveyance direction of the sheet 242 is turned substantially 90° C.

At this time, alternative voltages are applied to the charging roller 256 so as to alternately repeat positive and negative outputs. Accordingly, the conveyance belt 251 is charged with a band pattern in which a positively-charged area and a negatively-charged area are alternately repeated in the sub-scanning direction (belt circulation direction). When the sheet 242 is fed onto the conveyance belt 251 charged with positive and negative voltages, the sheet 242 is attracted to the conveyance belt 251 and conveyed in the sub-scanning direction as the conveyance belt 251 circulates.

The image forming apparatus 2000 also drives the recording heads 234 in accordance with image signals while moving the carriage 233 and ejects droplets onto the sheet halted to record one line of a desired image. After feeding the sheet 242 by a certain amount, the image forming apparatus 2000 records another line. Receiving a recording end signal or a signal indicating that a rear end of the sheet 242 has reached a recording area, the image forming apparatus 2000 finished the recording operation and outputs the sheet 242 to the sheet-output tray 203.

Thus, the image forming apparatus 2000 employing the liquid ejection head according to the present illustrative embodiment provides stable droplet ejection performance and excellent durability (wiping resistance), allowing stable formation of high-quality images over a relatively long period.

In the above-described embodiments, the image forming apparatus is described as a printer. However, it is to be noted that the image forming apparatus is not limited to the printer and may be another type of image forming apparatus, such as a multi-functional peripheral having several capabilities of a printer, a facsimile machine, and a copier. Alternatively, the image forming apparatus may be an image forming apparatus for patterning as described above. Further, the image forming apparatus may be a line-head-type image forming apparatus as well as the above-described serial-type image forming apparatus.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. A liquid ejection head, comprising:

a nozzle formation member comprising a nozzle substrate and a liquid repellent layer disposed on a droplet ejection face of the nozzle substrate in which one or more nozzle orifices is formed to eject droplets, the liquid repellent layer comprising a first sub-layer and a second sub-layer, the first sub-layer has the property of liquid repellency, the second sub-layer has liquid repellency, the first sub-layer containing a higher proportion of low-molecular-weight molecules than the second sub-layer, the second sub-layer containing a higher proportion of high-molecular-weight molecules than the first sub-layer, both the first sub-layer and the second sub-layer are exposed on a surface of a droplet ejection side of the nozzle formation member.

2. The liquid ejection head according to claim 1, wherein the first sub-layer is formed across the droplet ejection face of the nozzle substrate and the second sub-layer is scattered in island shapes on the first layer.

3. The liquid ejection head according to claim 1, wherein the liquid-repellent layer is made of fluorocarbon resin.

4. The liquid ejection head according to claim 3, wherein an inorganic oxide layer formed between the nozzle substrate and the liquid-repellent layer.

5. The liquid ejection head according to claim 4, wherein a metal layer having an oxide-formation free energy lower than the nozzle substrate is formed between the nozzle substrate and the inorganic oxide layer.

6. A liquid ejection head, comprising:

a nozzle formation member comprising a liquid repellent layer disposed on a droplet ejection face of a nozzle substrate in which one or more nozzle orifices is formed to eject droplets, the liquid repellent layer comprising a first sub-layer and a second sub-layer, the first sub-layer containing a higher proportion of low-molecules-weight than the second sub-layer, the second sub-layer containing a higher proportion of high-molecular-weight molecules than the first sub-layer both the first sub-layer and the second sub-layer exposed on a surface of the nozzle formation member, wherein a proximal portion of the nozzle formation member adjacent to the one or more nozzle orifices is less in surface irregularities and greater in the thickness of the liquid-repellent layer up to an edge of the one or more nozzle orifices than a distal portion of the nozzle formation member farther from the one or more nozzle orifices than the proximal portion of the nozzle formation member.

7. The liquid ejection head according to claim 6, wherein the proximal portion is concave.

8. The liquid ejection head according to claim 6, wherein the first sub-layer is formed across the droplet ejection face of the nozzle substrate and the second sub-layer is scattered in island shapes on the first layer.

9. The liquid ejection head according to claim 6, wherein the liquid-repellent layer is made of fluorocarbon resin.

10. The liquid ejection head according to claim 9, wherein an inorganic oxide layer is formed between the nozzle substrate and the liquid-repellent layer.

11. The liquid ejection head according to claim 10, wherein a metal layer having an oxide-formation free energy lower than the nozzle substrate is formed between the nozzle substrate and the inorganic oxide layer.

12. An image forming apparatus comprising a liquid ejection head, the liquid ejection head comprising a nozzle formation member comprising a nozzle substrate and a liquid repellent layer disposed on a droplet ejection face of the nozzle substrate in which one or more nozzle orifices is formed to eject droplets, the liquid repellent layer comprising a first sub-layer and a second sub-layer, the first sub-layer has the property of liquid repellency, the second sub-layer has the property of liquid repellency, the first sub-layer containing a higher proportion of low-molecular-weight molecules than the second sub-layer, the second sub-layer containing a higher proportion of high-molecular-weight molecules than the first sub-layer, both the first sub-layer and the second sub-layer are exposed on a surface of a droplet ejection side of the nozzle formation member.

13. The image forming apparatus according to claim 12, further comprising a wiping member to wipe the surface of the nozzle formation member, wherein the second sub-layer of the liquid repellent sub-layer of the liquid ejection head is arranged parallel to a wiping direction of the wiping member.

14. The image forming apparatus according to claim 13, wherein the liquid ejection head includes a foundation layer on which the liquid-repellent layer is formed and the foundation layer has a groove parallel to the wiping direction of the wiping member.

15. The image forming apparatus according to claim 14, wherein the groove of the liquid ejection head is not connected to the nozzle orifice.

* * * * *